US008061957B1

(12) United States Patent
Callens

(10) Patent No.: US 8,061,957 B1
(45) Date of Patent: Nov. 22, 2011

(54) GRAPPLING FORK ATTACHMENT SYSTEM

(76) Inventor: Albert C. Callens, Taunton, MN (US)

( * ) Notice: Subject to any disclaimer, the term of this patent is extended or adjusted under 35 U.S.C. 154(b) by 304 days.

(21) Appl. No.: 12/366,380

(22) Filed: Feb. 5, 2009

Related U.S. Application Data

(63) Continuation-in-part of application No. 11/279,185, filed on Apr. 10, 2006, now abandoned.

(51) Int. Cl.
*B66C 1/00* (2006.01)

(52) U.S. Cl. ..... 414/724; 37/403; 37/903; 74/89.21; 414/912

(58) Field of Classification Search ..... 414/724, 414/729, 912; 37/403, 406, 903; 74/89.22, 74/89.21
See application file for complete search history.

(56) References Cited

U.S. PATENT DOCUMENTS

| | | | | |
|---|---|---|---|---|
| 4,155,473 | A | 5/1979 | Holopainen | |
| 4,403,906 | A | 9/1983 | Holopainen | |
| 4,669,947 | A | 6/1987 | Frost | |
| 4,688,985 | A * | 8/1987 | Hartman | 414/744.6 |
| 4,803,788 | A | 2/1989 | Sorenson | |
| 5,314,292 | A | 5/1994 | Holopainen | |
| 5,486,085 | A | 1/1996 | Gagne et al. | |
| 5,639,205 | A * | 6/1997 | Kaczmarczyk et al. | 414/723 |
| 5,678,332 | A | 10/1997 | Hawkins | |
| 5,839,322 | A * | 11/1998 | Genov et al. | 74/490.01 |
| 5,927,933 | A | 7/1999 | Tucker | |
| 5,957,650 | A | 9/1999 | Rollo | |
| 6,109,859 | A * | 8/2000 | Domann | 414/729 |
| 6,209,237 | B1 | 4/2001 | Heiple et al. | |
| 6,742,291 | B2 | 6/2004 | Frigon et al. | |
| 2005/0188568 | A1 | 9/2005 | Clapper, Jr. | |
| 2005/0193599 | A1 | 9/2005 | McCoy | |

* cited by examiner

*Primary Examiner* — Donald Underwood
(74) *Attorney, Agent, or Firm* — Neustel Law Offices

(57) ABSTRACT

A grappling fork attachment system for attaching a grappling fork to a conventional bucket, where the grappling fork does not interfere with the normal use of the bucket. The grappling fork attachment system includes a support frame pivotally attached to a tractor between a bucket unit and a pair of loader arms, wherein the support frame may securely attach to either the bucket unit or the pair of loader arms. An extension frame is pivotally attached to the support frame and a first drive assembly mounted proximate the extension frame for pivoting the extension frame about the support frame. A grappling structure is pivotally attached to the extension frame for grabbing and securing a load within the bucket of the tractor and a second drive assembly mounted proximate the extension frame for pivoting the grappling structure about the extension frame.

10 Claims, 27 Drawing Sheets

GRAPPLING FORK ATTACHMENT SYSTEM

CROSS REFERENCE TO RELATED APPLICATIONS

I hereby claim benefit under Title 35, United States Code, Section 120 of U.S. patent application Ser. No. 11/279,185 filed Apr. 10, 2006 now abandoned. This application is a continuation in-part of the Ser. No. 11/279,185 application. The Ser. No. 11/279,185 application is currently pending. The Ser. No. 11/279,185 application is hereby incorporated by reference into this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to grappling forks and more specifically it relates to a grappling fork attachment system for attaching a grappling fork to a conventional bucket, where the grappling fork does not interfere with the normal use of the bucket.

2. Description of the Related Art

Any discussion of the prior art throughout the specification should in no way be considered as an admission that such prior art is widely known or forms part of common general knowledge in the field.

Grappling forks have been in use for years. Typically, a grappling fork attaches to the upper end of a conventional bucket, with the grappling fork having a single pivot point at the point of attachment. In the grappling forks down position, it rests over the opening of the bucket. This keeps whatever is in the bucket secure and prevents large outside objects from entering the bucket. In a raised position of the grappling fork, it generally sticks straight up into the air, above the bucket. This opens up the bucket to receive or dispense objects.

When past grappling forks have been attached to conventional buckets, it is usually difficult to operate the bucket in a traditional manner. To load objects into the bucket, the grappling fork must be in a raised position. This greatly decreases the operator's view of what they are loading into the bucket.

While these devices may be suitable for the particular purpose to which they address, they are not as suitable for attaching a grappling fork to a conventional bucket, where the grappling fork does not interfere with the normal use of the bucket. Past grappling forks generally have to be removed from the bucket that they are attached to during times when the grappling fork is not needed. This is because the grappling fork can be an obstruction to the operator's view and also can decrease maneuverability of the bucket because of their size.

In these respects, the grappling fork attachment system according to the present invention substantially departs from the conventional concepts and designs of the prior art, and in so doing provides an apparatus primarily developed for the purpose of attaching a grappling fork to a conventional bucket, where the grappling fork does not interfere with the normal use of the bucket.

BRIEF SUMMARY OF THE INVENTION

In view of the foregoing disadvantages inherent in the known types of grappling forks now present in the prior art, the present invention provides a new grappling fork attachment system construction wherein the same can be utilized for attaching a grappling fork to a conventional bucket, where the grappling fork does not interfere with the normal use of the bucket.

The general purpose of the present invention, which will be described subsequently in greater detail, is to provide a new grappling fork attachment system that has many of the advantages of the grappling forks mentioned heretofore and many novel features that result in a new grappling fork attachment system which is not anticipated, rendered obvious, suggested, or even implied by any of the prior art grappling forks, either alone or in any combination thereof.

To attain this, the present invention generally comprises a support frame pivotally attached to a tractor between a bucket unit and a pair of loader arms, wherein the support frame may securely attach to either the bucket unit or the pair of loader arms. An extension frame is pivotally attached to the support frame and a first drive assembly mounted proximate the extension frame for pivoting the extension frame about the support frame. A grappling structure is pivotally attached to the extension frame for grabbing and securing a load within the bucket of the tractor and a second drive assembly mounted proximate the extension frame for pivoting the grappling structure about the extension frame.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a grappling fork attachment system that will overcome the shortcomings of the prior art devices.

A second object is to provide a grappling fork attachment system for attaching a grappling fork to a conventional bucket, where the grappling fork does not interfere with the normal use of the bucket.

A second object is to provide a grappling fork attachment system for attaching a grappling fork to a bucket of a tractor loader.

A second object is to provide a grappling fork attachment system for attaching a grappling fork to a bucket of a skid steer loader.

Another object is to provide a grappling fork attachment system that is able to secure objects in a bucket.

An additional object is to provide a grappling fork attachment system that is able to fold and store behind a bucket while remaining attached to the bucket.

A further object is to provide a grappling fork attachment system that is attachable to various bucket sizes.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
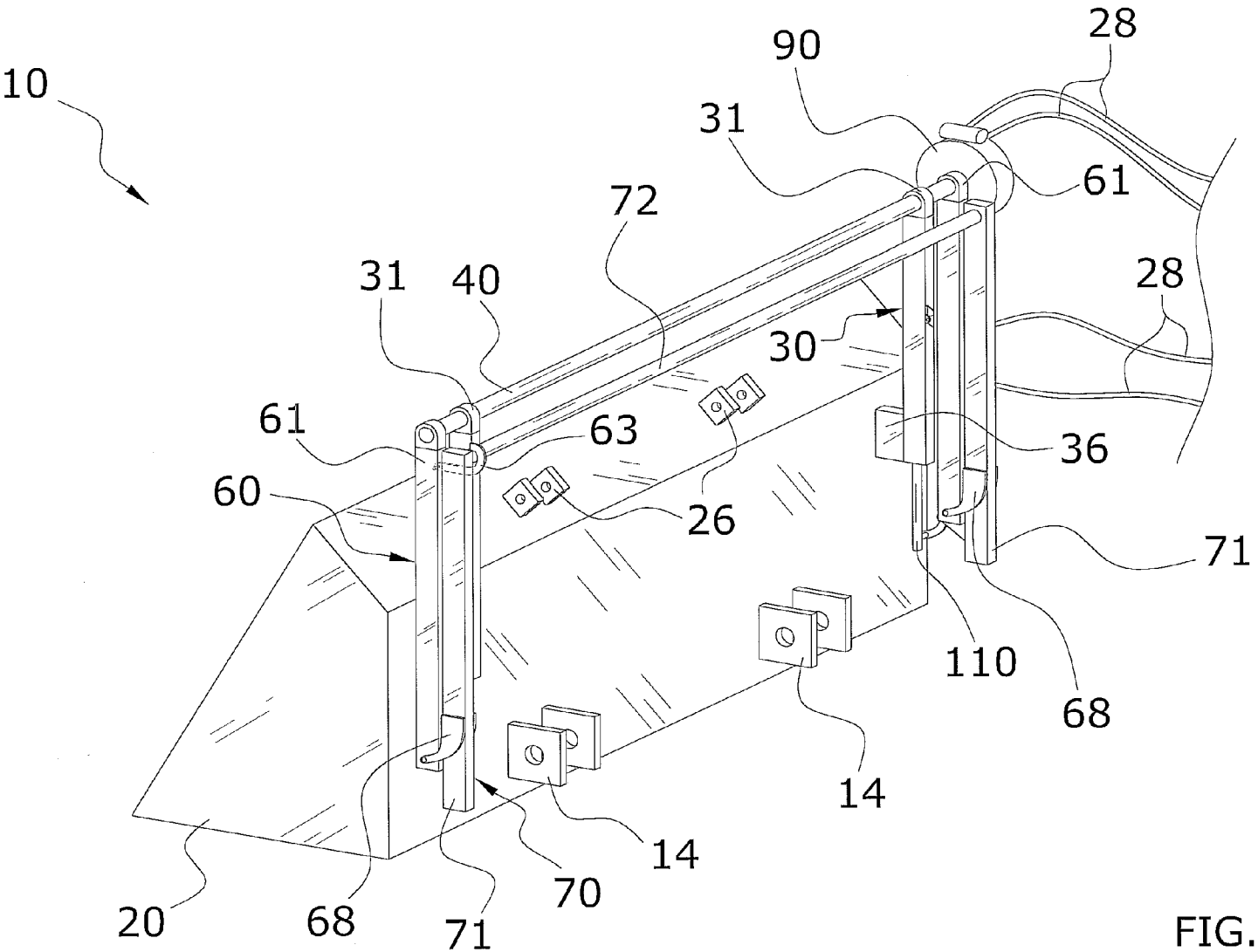
FIG. 1 is an upper perspective view of the present invention attached to a bucket.

Turning now descriptively to the drawings, in which similar reference characters denote similar elements throughout the several views, FIGS. 1 through 27*b* illustrate a grappling fork attachment system 10, which comprises a support frame 30 pivotally attached to a tractor between a bucket unit 20 and a pair of loader arms 13, wherein the support frame 30 may securely attach to either the bucket unit 20 or the pair of loader arms 13. An extension frame 60 is pivotally attached to the support frame 30 and a first drive assembly 80 mounted proximate the extension frame 60 for pivoting the extension frame 60 about the support frame 30. A grappling structure 70 is pivotally attached to the extension frame 60 for grabbing and securing a load 19 within the bucket 20 of the tractor 12 and a second drive assembly 100 mounted proximate the extension frame 60 for pivoting the grappling structure 70 about the extension frame 60.

B. Tractor/Skid Steer Loader

The present invention may attach to various types of machinery 12, such as but not limited to a tractor or a skid steer loader. It is appreciated that the term tractor may be used herein and is not meant to be limited, wherein the present invention may attach to various types of machinery, such as but not limited to tractors, skid steer loaders, vehicles, automobiles, stationary objects, and the like. The present invention preferably attaches at the front end of the machinery and further preferably at the intersecting point between the bucket unit 20 and the loader arms 13.

The bucket unit 20 is comprised of a conventional bucket to carry various sizes of loads 19. The bucket unit 20 includes a pair of arm attachments 14 to attach to the loader arms 13 of the tractor/skid steer loader 12. The loader arms 13, when attached to the arm attachments 14, are able to elevate and lower the bucket unit 20.

Figure 3:
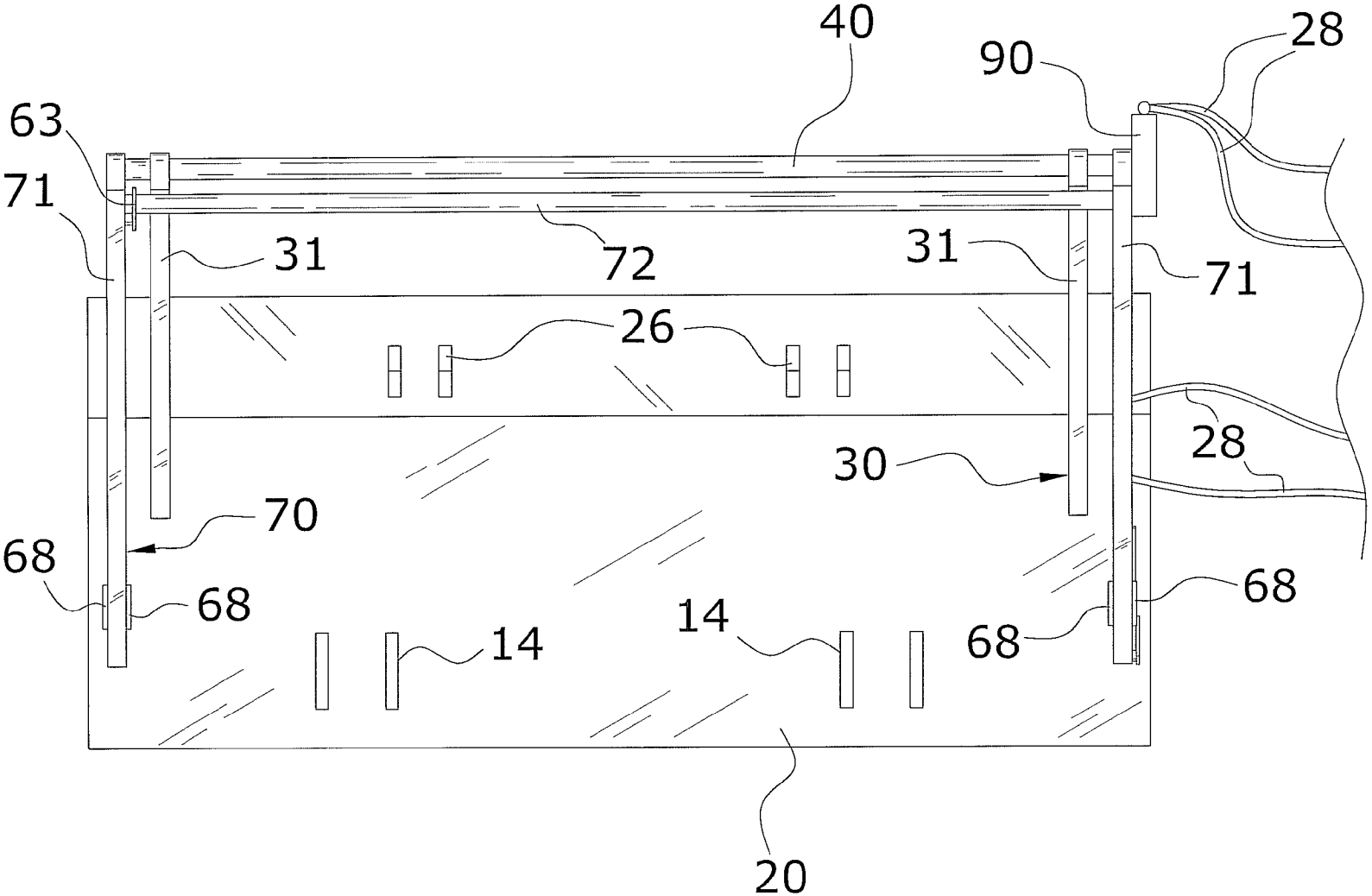
FIG. 3 is a rear view of the present invention attached to a bucket.
Figure 4:
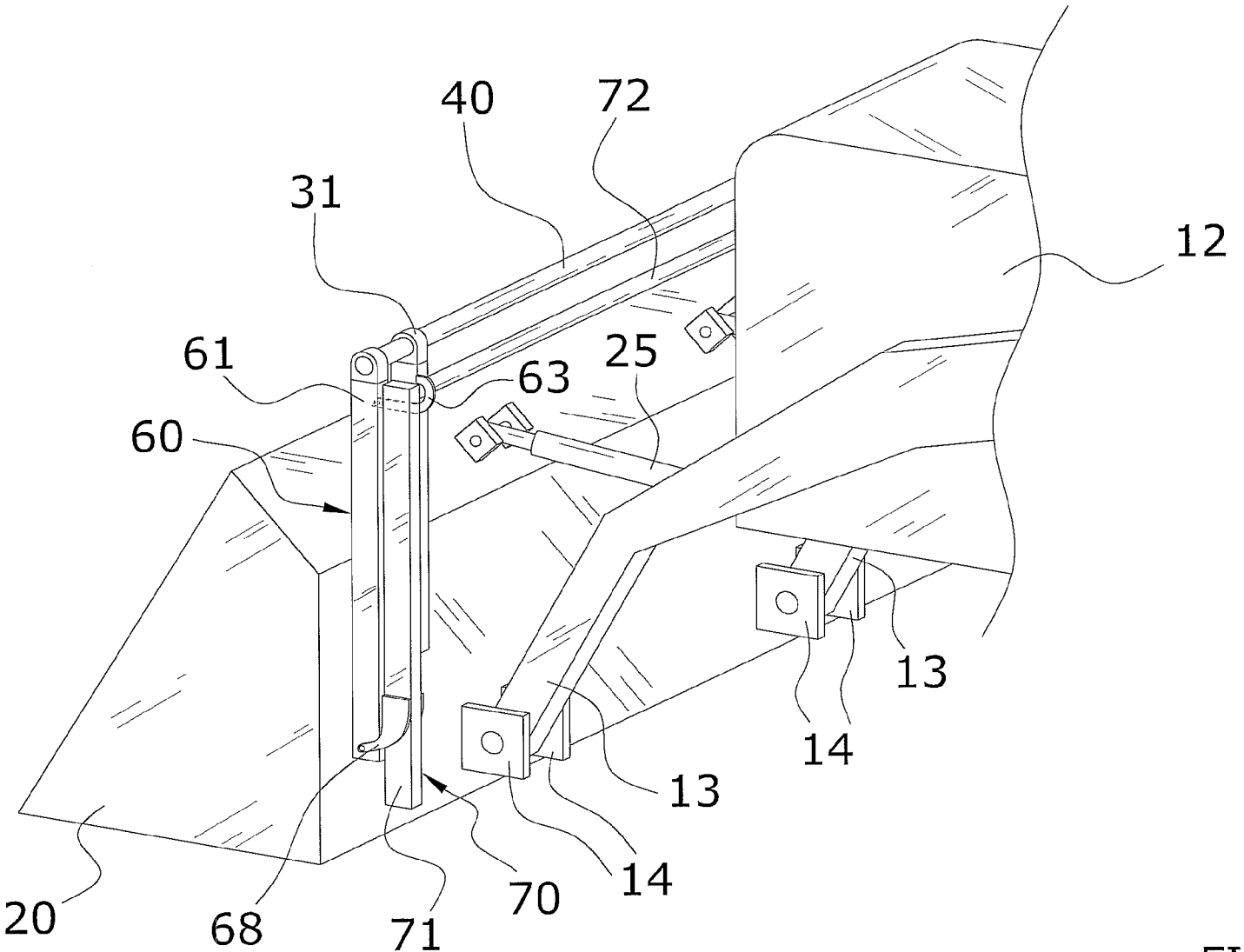
FIG. 4 is an upper perspective view of the present invention attached to a bucket and the bucket attached to a tractor.
Figure 5:
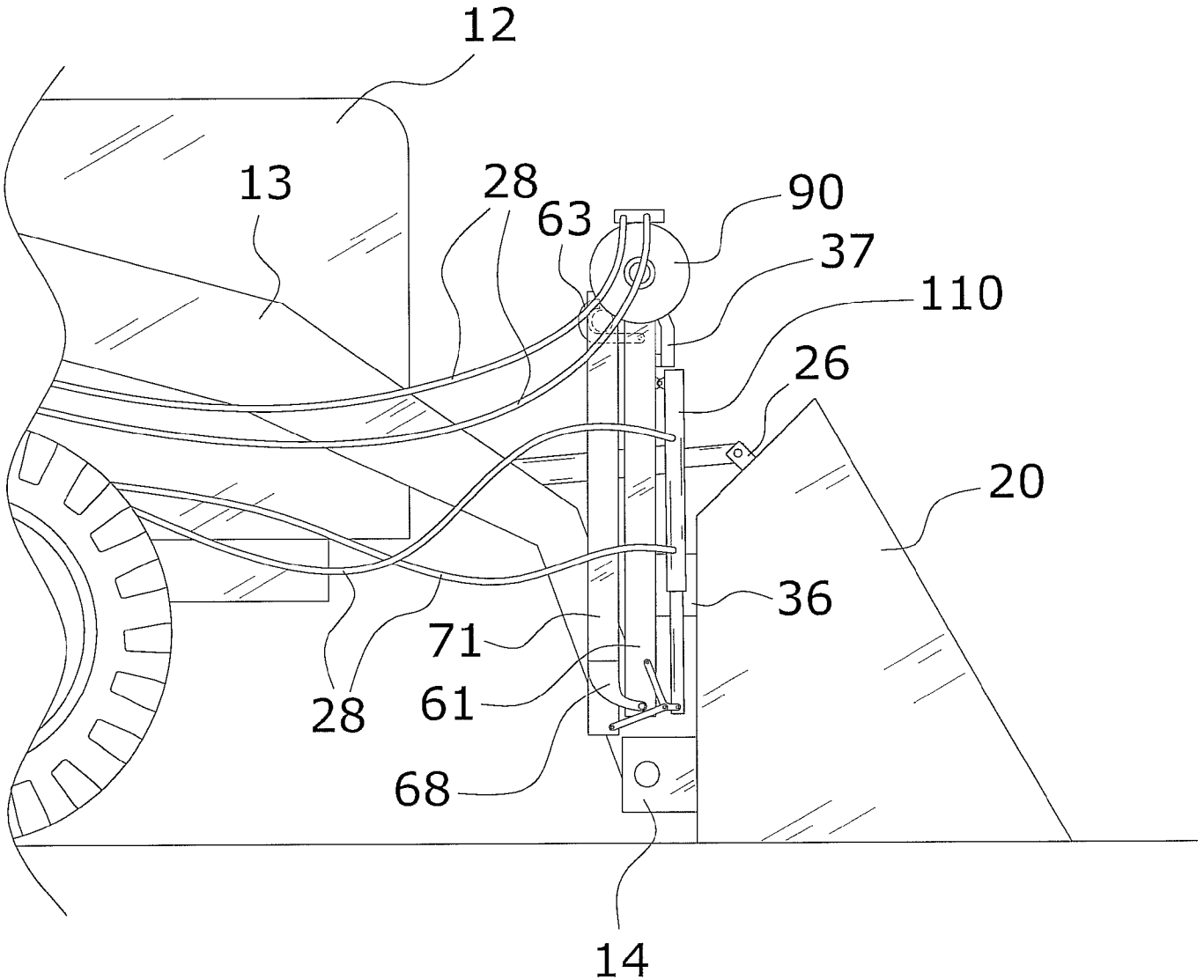
FIG. 5 is a side view of the present invention attached to a bucket and the bucket attached to a tractor.
Figure 6:
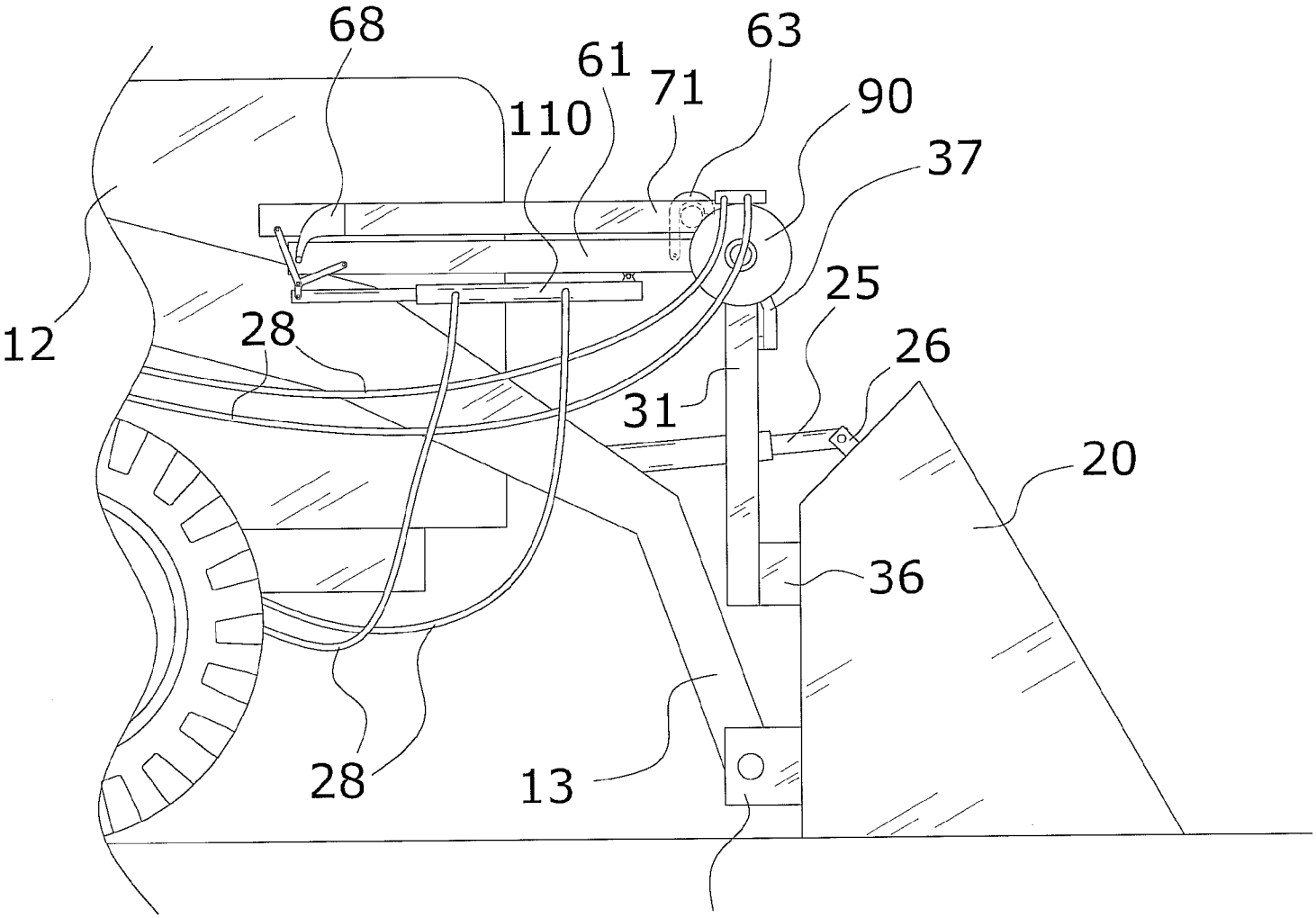
FIG. 6 is a side view of the present invention attached to a bucket, the bucket attached to a tractor and the fourth and sixth members pivoted parallel with the ground.
Figure 7:
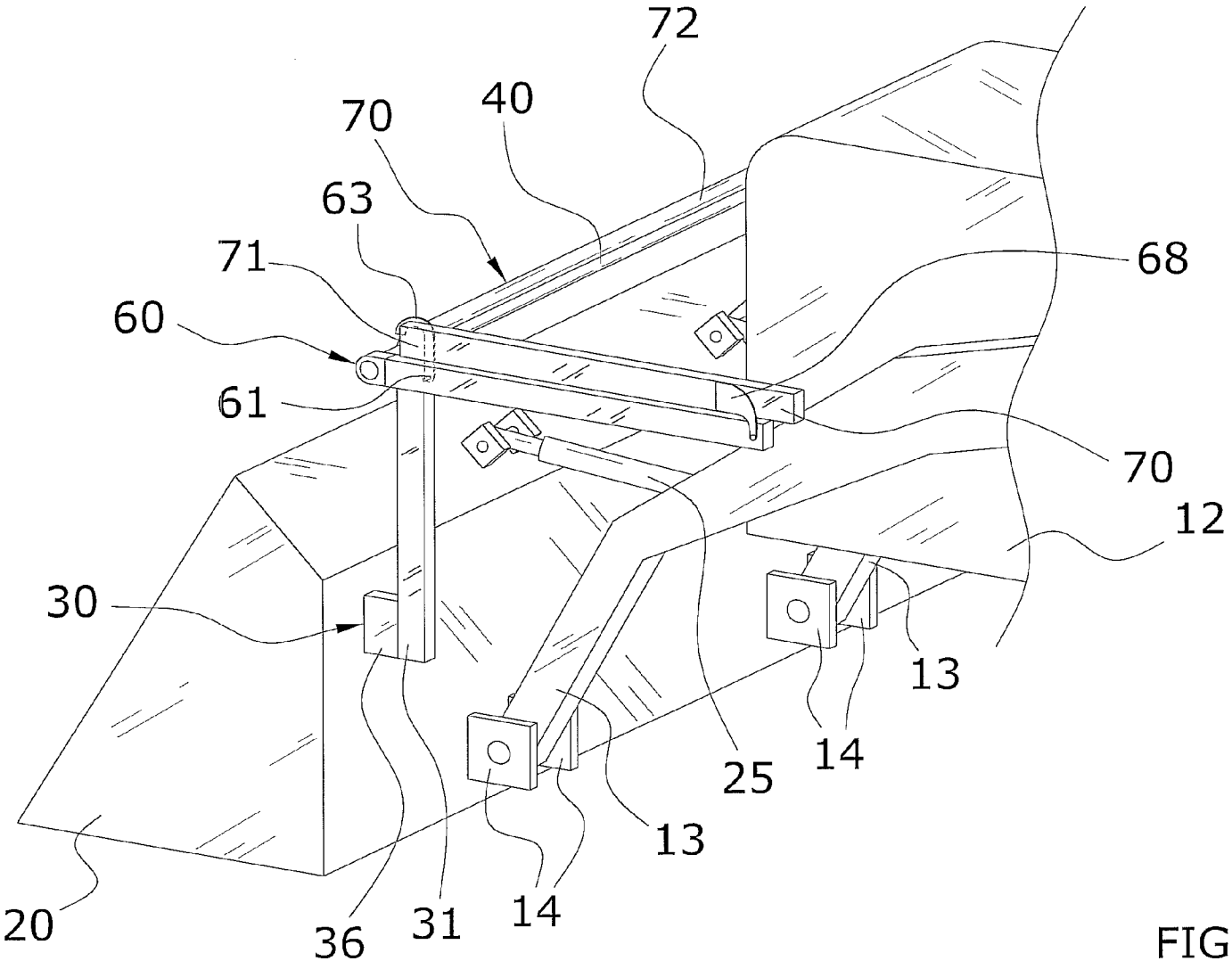
FIG. 7 is an upper perspective view of the present invention attached to a bucket, the bucket attached to a tractor and the fourth and sixth members pivoted parallel with the ground.
Figure 8:
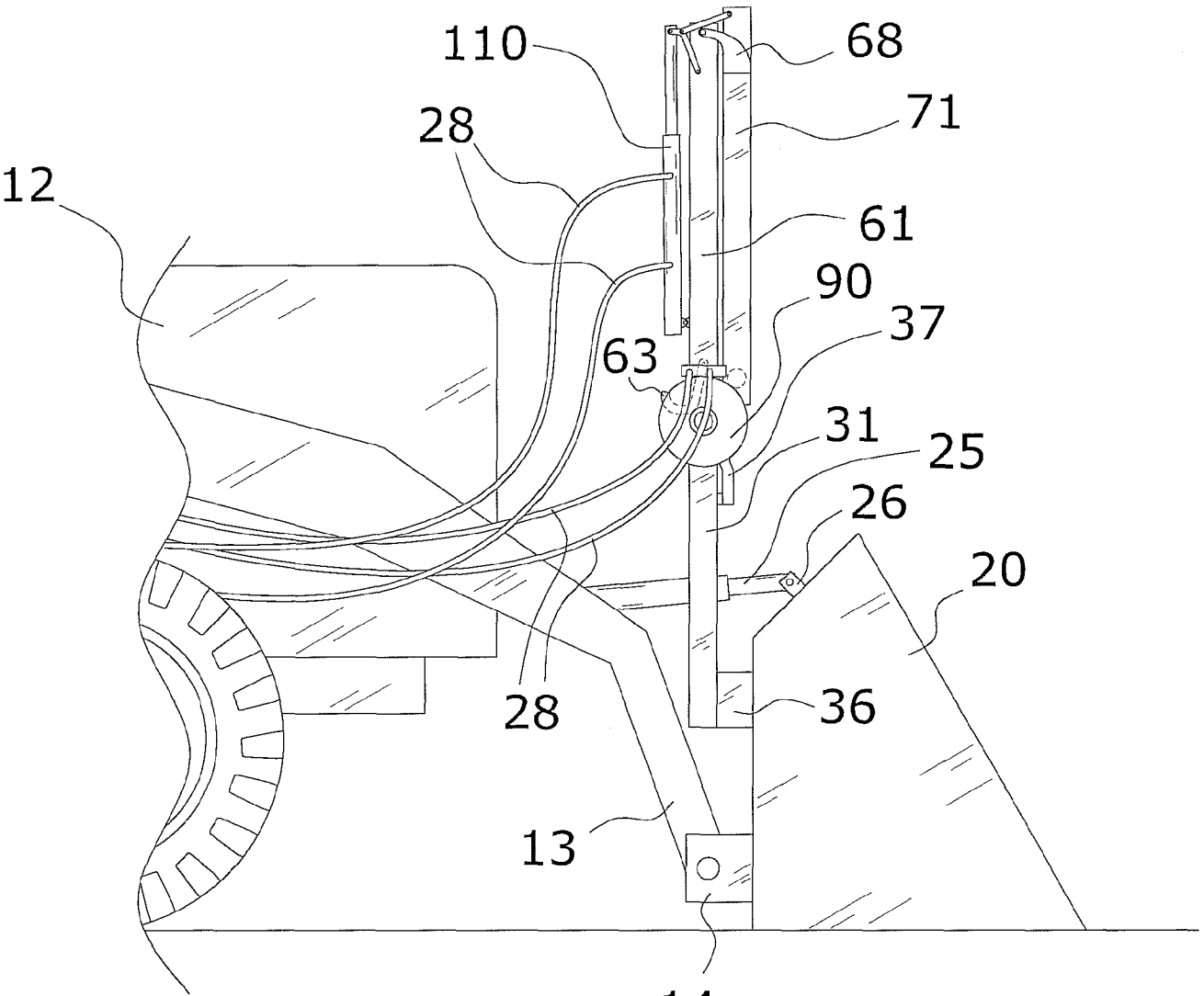
FIG. 8 is a side view of the present invention attached to a bucket, the bucket attached to a tractor and the present invention pivoted in a half-way upright position.
Figure 9:
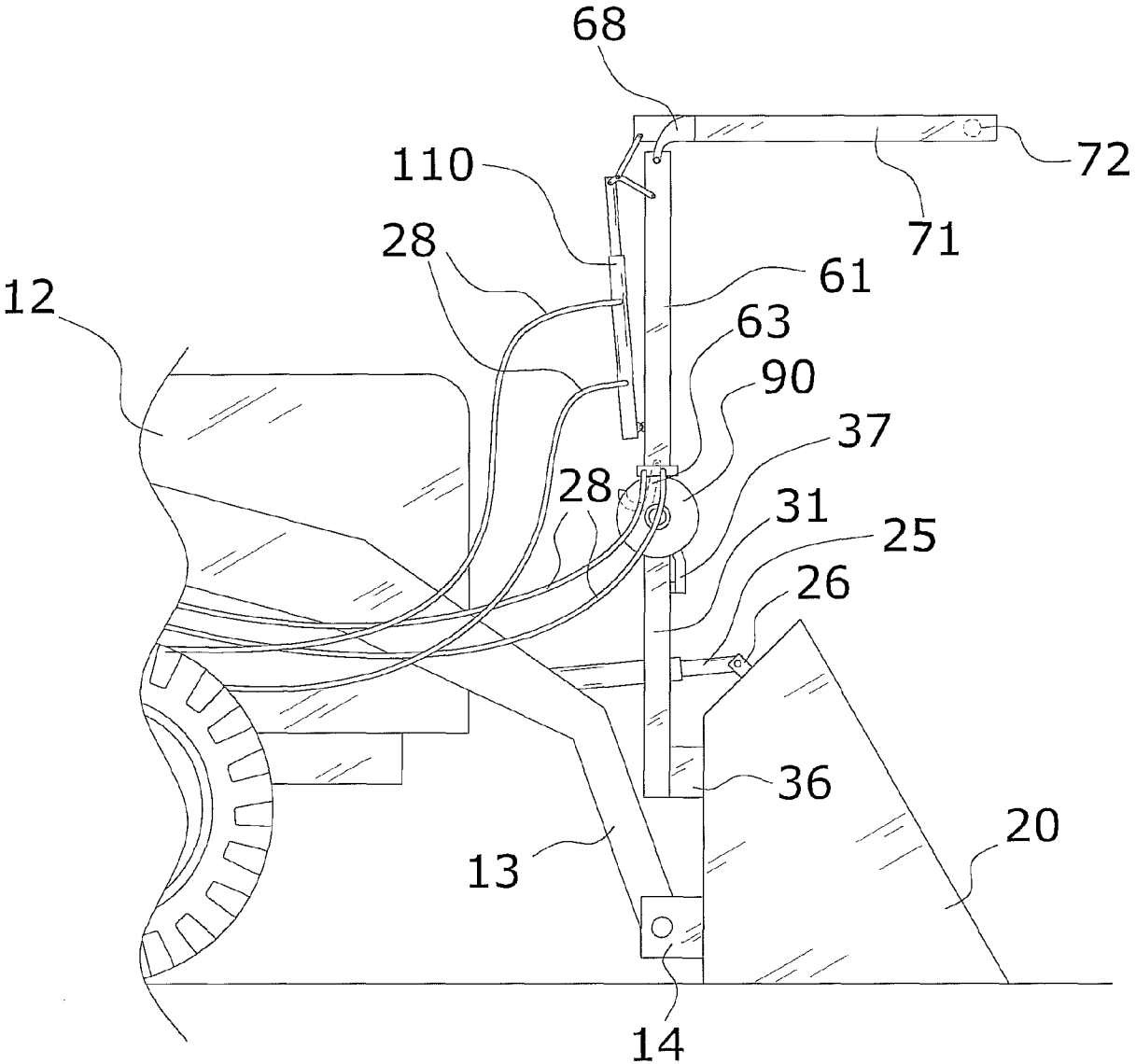
FIG. 9 is a side view of the present invention attached to a bucket, the bucket attached to a tractor, the fourth member pivoted in an upright position and sixth member pivoted parallel with the ground.
Figure 10:
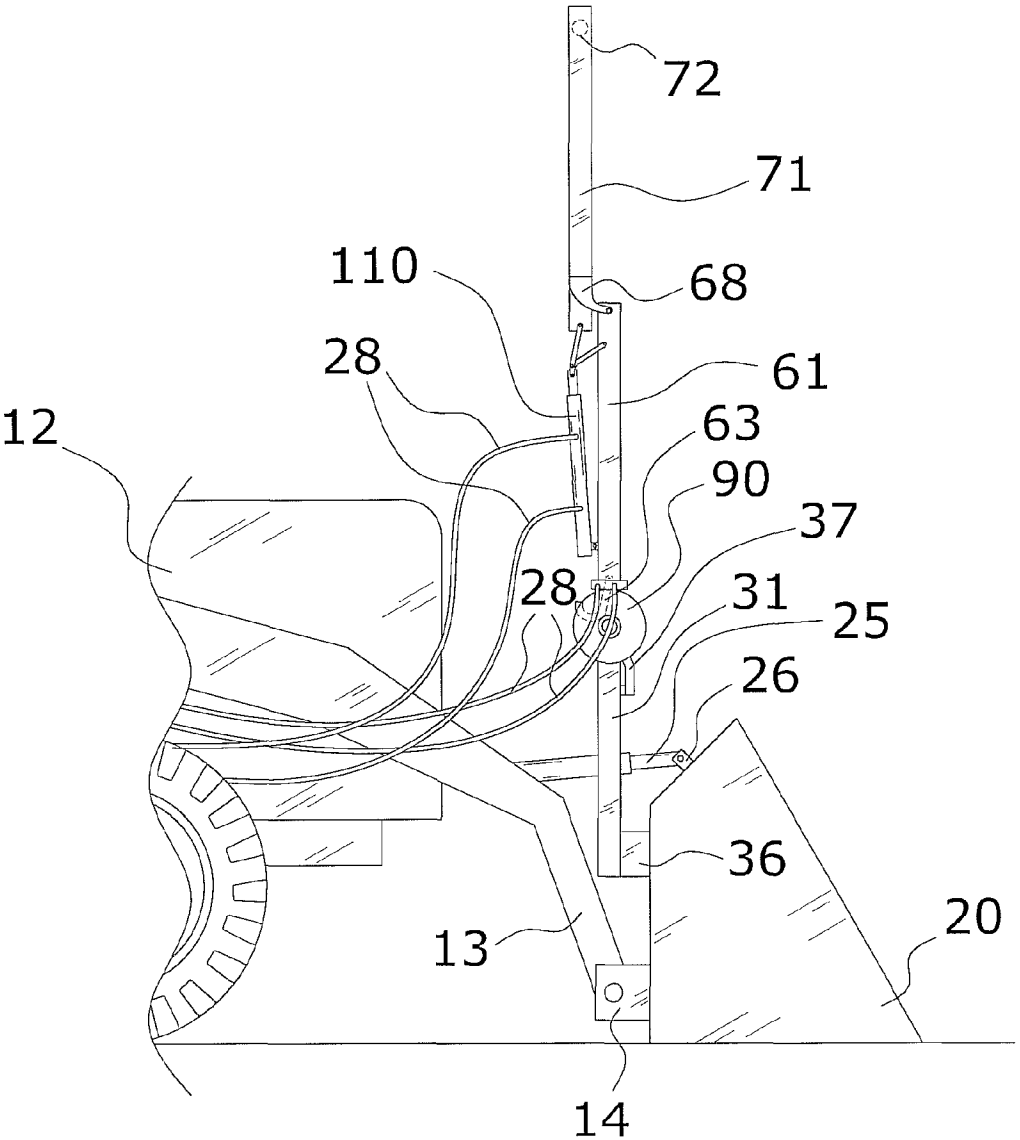
FIG. 10 is a side view of the present invention attached to a bucket, the bucket attached to a tractor and the present invention pivoted in a fully upright position.
Figure 11:
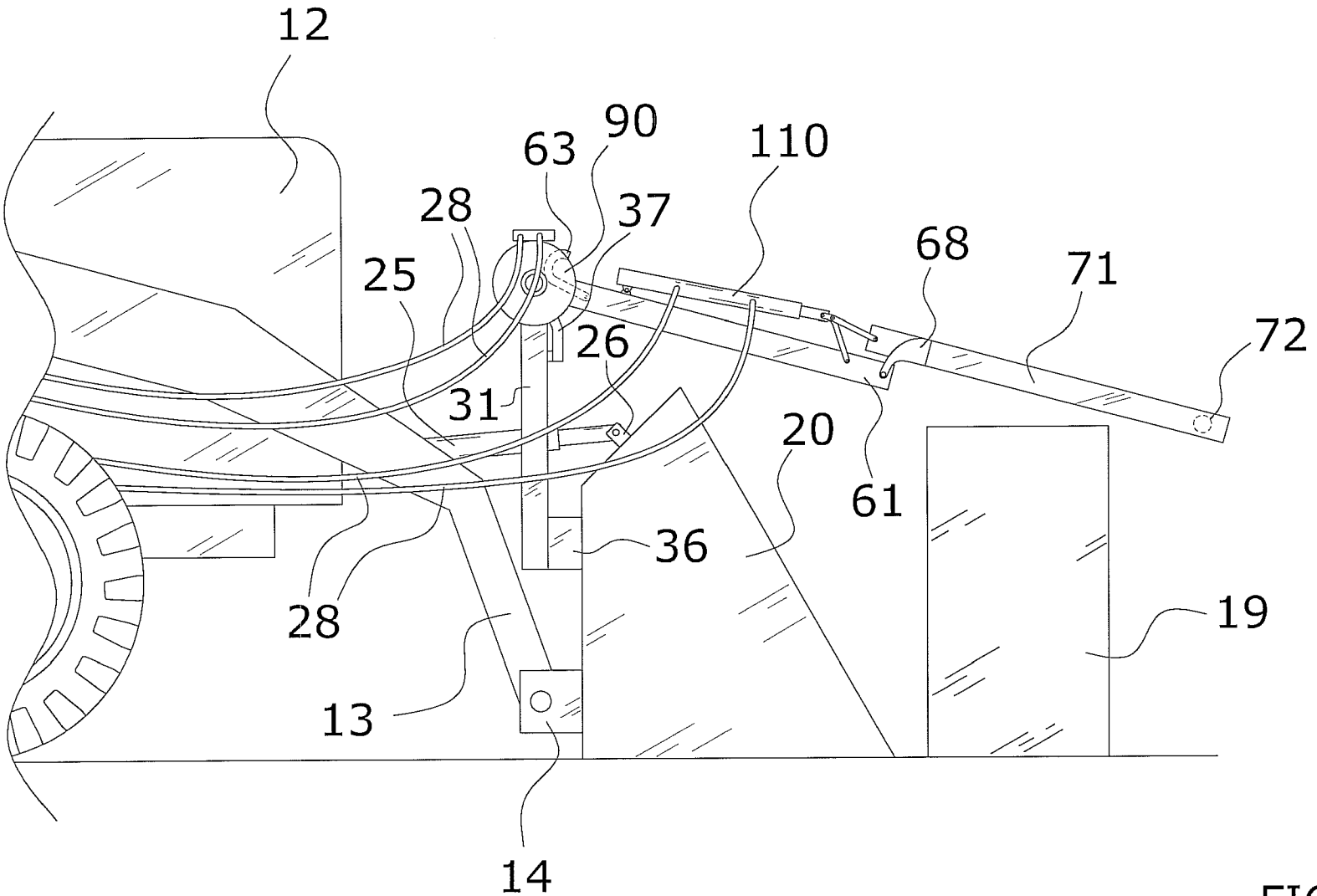
FIG. 11 is a side view of the present invention attached to a bucket, the bucket attached to a tractor and the present invention pivoted in an outward position.
Figure 12:
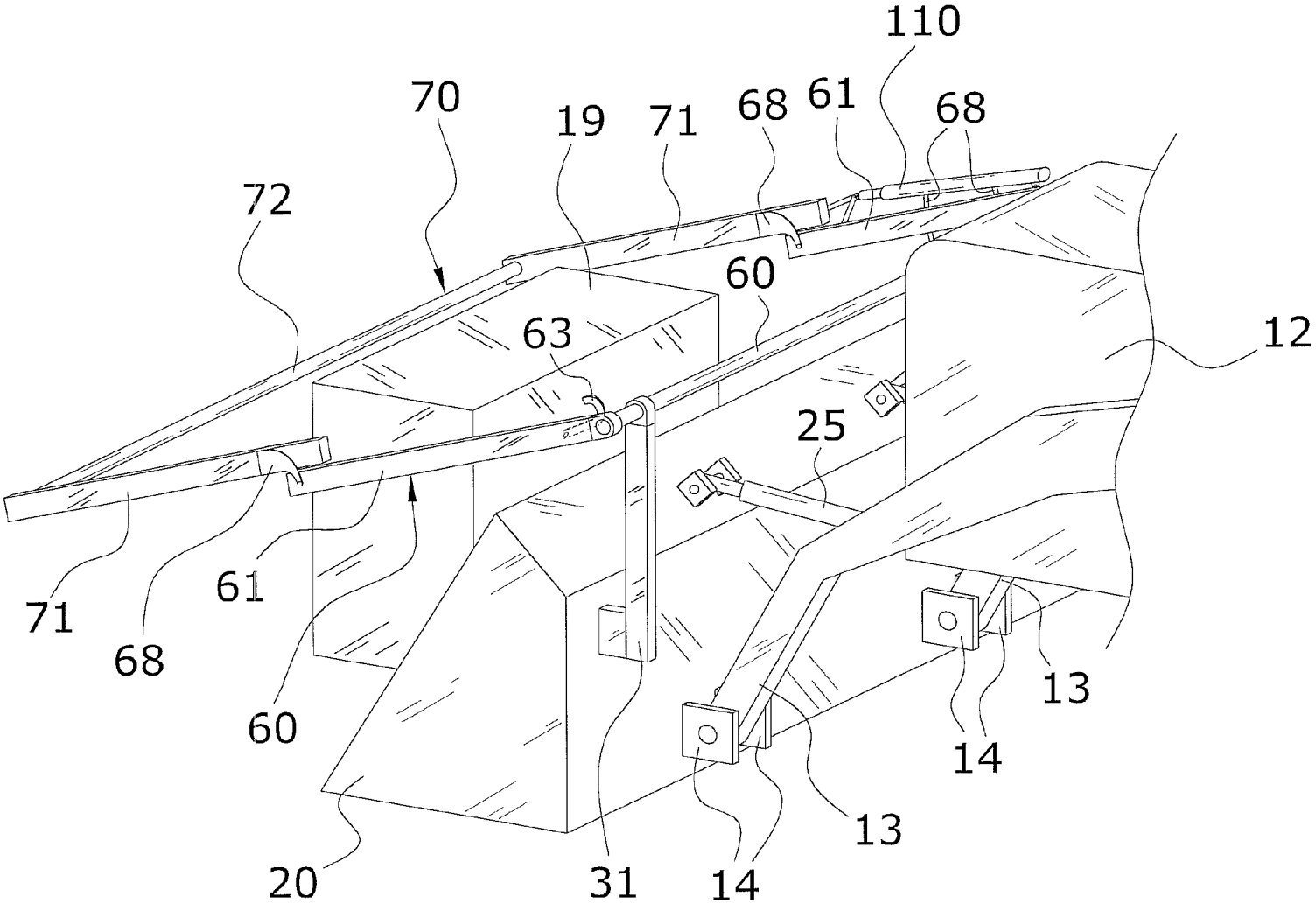
FIG. 12 is an upper perspective view of the present invention attached to a bucket, the bucket attached to a tractor and the present invention pivoted in an outward position.

The bucket unit 20 preferably also includes at least one actuator 25, preferably of the hydraulic type. The actuator 25 is preferably positioned on the rear of the bucket unit 20 near the upper end, as shown in FIGS. 1, 3 and 4. The actuator attaches is pivotally secured to the bucket unit 20 via an attachment 26. Various hydraulic hoses 29 are used to supply hydraulic fluid to the various actuators of the present invention.

The present invention is secured to the loader arms 13 via a pair of arm retaining flanges 15 when not using the present invention and is secured to the bucket unit 20 via a pair of bucket retaining flanges 22, 32 when in use.

A pair of support members 21 extend vertically along the back end of the bucket unit 20 to attach to the support frame 30 and more particularly the support members 31 of the support frame 30. The lower end of the support members 21 of the support frame 30 extends angularly downward and away from the bucket 20 and pivotally connects with the support members 31 of the support frame 30 which includes a lower end that extends angularly downward and toward the loader arms 13. It is appreciated that the bucket retaining flange 22 extends from the upper end of the support members 21 of the support frame 30.

C. Support Frame

The support frame 30 is comprised of a structure and configuration to attach to the rear of the bucket unit 20 and more particularly the support members 21 of the support frame 30. The support members 21 of the support frame 30 are parallel to each other as are the support members 31. Another bucket retaining flange 32 extends from the upper end of the support members 31 of the support frame 30 to align with the bucket retaining flange 22 of the support members 21 of the support frame 30 so that the support frame 30 can be locked to the bucket unit 20 when the grappling fork attachment 10 is in use. A support plate 34 also extends from the rear of the support members 31 of the support frame 30 so as to catch and support the support members 21 of the support frame 30 when positioned next to each other.

The support members 21, in the new embodiment, may also include a bucket attachment 36 to secure to the support frame 30 to the bucket unit 20 as shown in FIGS. 4 through 6 and 7 through 13. The bucket attachments 36 attach the support members 21 of the support frame 30.

D. Locking Element

A locking element 50 is pivotally attached to the upper end of the support members 31 of the support frame 30 to secure the support frame 30 and thus grappling fork attachment 10 to either the bucket unit 20 or the loader arms 13. The locking element 50 is pivotally secured to the support frame 30 and functions as a rocker arm. The locking element 50 includes a first securing portion 52 to be secured within a slot of an arm retaining flange 15 of the loader arms 13. When secured within the arm retaining flange 15, the locking element 50 prevents the support frame 30 from pivoting forward with the bucket unit 20. It is appreciated that in place of the securing portions 52, 53 extending within the slots of the flanges 15, 22, 32, electromagnetic solenoids may be used to temporarily attach the locking element 50 to elements of either the bucket unit 20 or the loader arms 13.

The locking element 50 also includes a second securing portion 53 that is secured within a slot formed by the bucket retaining flange 22 of the support frame member 21 and the bucket retaining flange 32 of the support frame 30. When secured within the bucket retaining flanges 22, 32, the locking element 50 secures the grappling fork attachment 10 to the bucket unit 20 so as to be able to move away from the loader arms 13.

The locking element 50 includes a catch portion 55 extending vertically upward from preferably the first securing portion 52. The catch portion 55 catches on the extension frame 60 when the extension frame 60 is pivoted toward the loader arms 13. When the extension frame 60 is in a resting or non use position and parallel with the loader arms 13, the extension frame 60 pushes downward upon the catch portion 55 so that the first securing portion 52 is secured within the arm retaining flange 15.

When the extension frame 60 is pivoted toward an in use position away from the loader arms 13, the pressure upon the catch portion 55 is relieved thus allowing the locking element 50 to pivot away from the arm retaining flange 15 and the second securing portion 53 to enter the aligned bucket retaining flanges 22, 32. It is appreciated that the locking element 50 is able to pivot via a spring 57 applying a downward pressure upon the second securing portion 53 so as to pull the second securing portion 53 within the bucket retaining flanges 22, 32. The extension frame 60, when pivoted towards the resting position is able to overcome the force of the spring 57 by pushing on the catch portion 55 and pivot the locking element 50 so as to be positioned within the arm retaining flange 15.

E. Cross Member

A cross member 40 may extend between the support members 31 of the support frame 30. As shown in FIGS. 8 through 15, an actuator 90 may mechanically attach between an attachment 37 of the support frame 30 and the extension frame 60. The actuator 90 is preferably comprised of a hydraulic configuration which may be powered through the tractor or other alternate power sources. It is appreciated that other drive assemblies may be used with the present invention as discussed subsequently.

The support members 31 may connect to the cross member 40 on the upper end through the use of bearings, etc. as shown in FIGS. 1 and 3. The cross member 40 may also include various internal shafts.

A cam 42 may also be positioned upon the cross member 40 to rotate with the cross member 40 or internal shafts when the extension frame 60 is rotated with respect to the support frame 30. The cam 42 serves to engage a valve 43 mounted proximate the cam 42 so as to cut off a flow of hydraulic fluid to the grappling fork attachment 10. The workings of the cam 42 and valve 43 will be described in more detail subsequently.

F. Extension Frame

The extension frame 60 is comprised of a structure and configuration to pivotally attach to the rear of the bucket unit 20 via the support frame 30. The extension frame 60 preferably includes a pair of extension arms 61 to extend across the bucket unit 20 towards a front of the bucket unit 20 so as to extend over a load 19, as shown in FIG. 1. The arms 61 are preferably of a similar configuration and are substantially parallel to each other.

At least one of the arms 61 may include a locking member 63. The locking member 63 is preferably pivotally attached to the inside of the respective arm 61, as shown in FIG. 1. The locking member 63 preferably secures a cross arm 72 of the grappling structure 70 to the respective arm of the extension frame 60. This is to prevent movement of the grappling structure 70 when the grappling fork attachment system is not in use such as an accidental engagement of the actuator 110.

Figure 2:
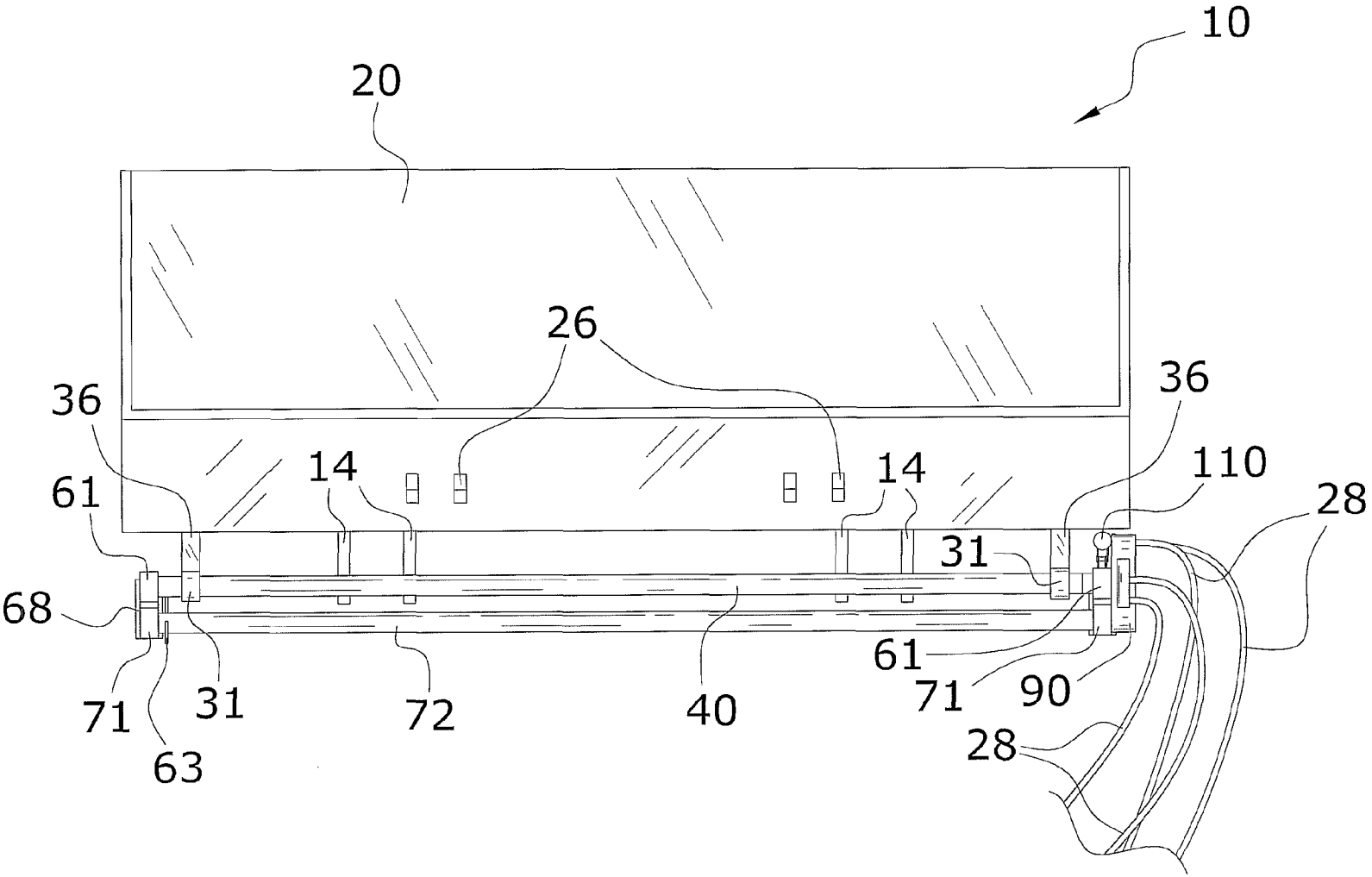
FIG. 2 is a top view of the present invention attached to a bucket.

The arms 61 are preferably attached to the cross member 40 on the outside of the arms 61, as shown in FIGS. 1 through 3.

The arms 61 also pivot as the actuator 90 rotates the cross member 40 or internal shafts, as shown in FIGS. 6 through 15. Another hydraulic actuator 110 may be mechanically connected between the extension frame 60 and the grappling structure 70, as shown in FIGS. 8 through 15. The arms 61 include a pivotal attachment 68 to secure the side arms 71 of the grappling structure 70 so that the grappling structure 70 may rotate about the extension frame 60 as shown in FIGS. 6 through 15. It is appreciated that other drive assemblies may be used with the present invention as discussed subsequently.

G. Grappling Structure

The grappling structure 70 is comprised of a structure and configuration to pivotally attach to the extension frame 60, as shown in FIGS. 1 through 15. The grappling structure 70 preferably includes a pair of side arms 71 and a cross arm 72 connecting the side arms 71 at an outward end so as to be furthest away from the bucket unit 20. The side arms 71 are preferably of a similar configuration and are substantially parallel to each other. The grappling structure 70 is positioned upon an inside of the extension frame 60.

Figure 13:
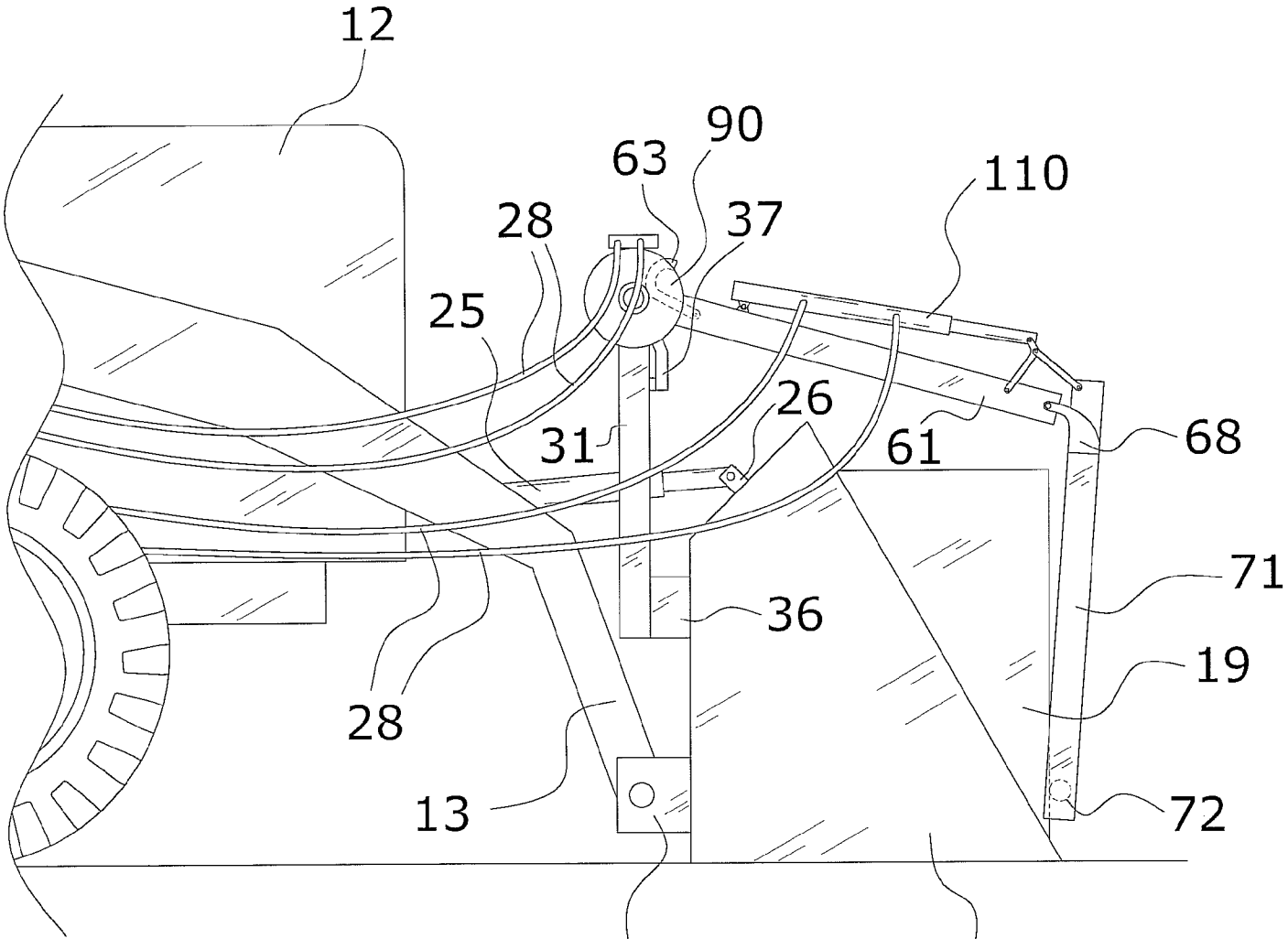
FIG. 13 is a side view of the present invention attached to a bucket, the bucket attached to a tractor and the present invention grabbing a load and securing the load in the bucket.
Figure 14:
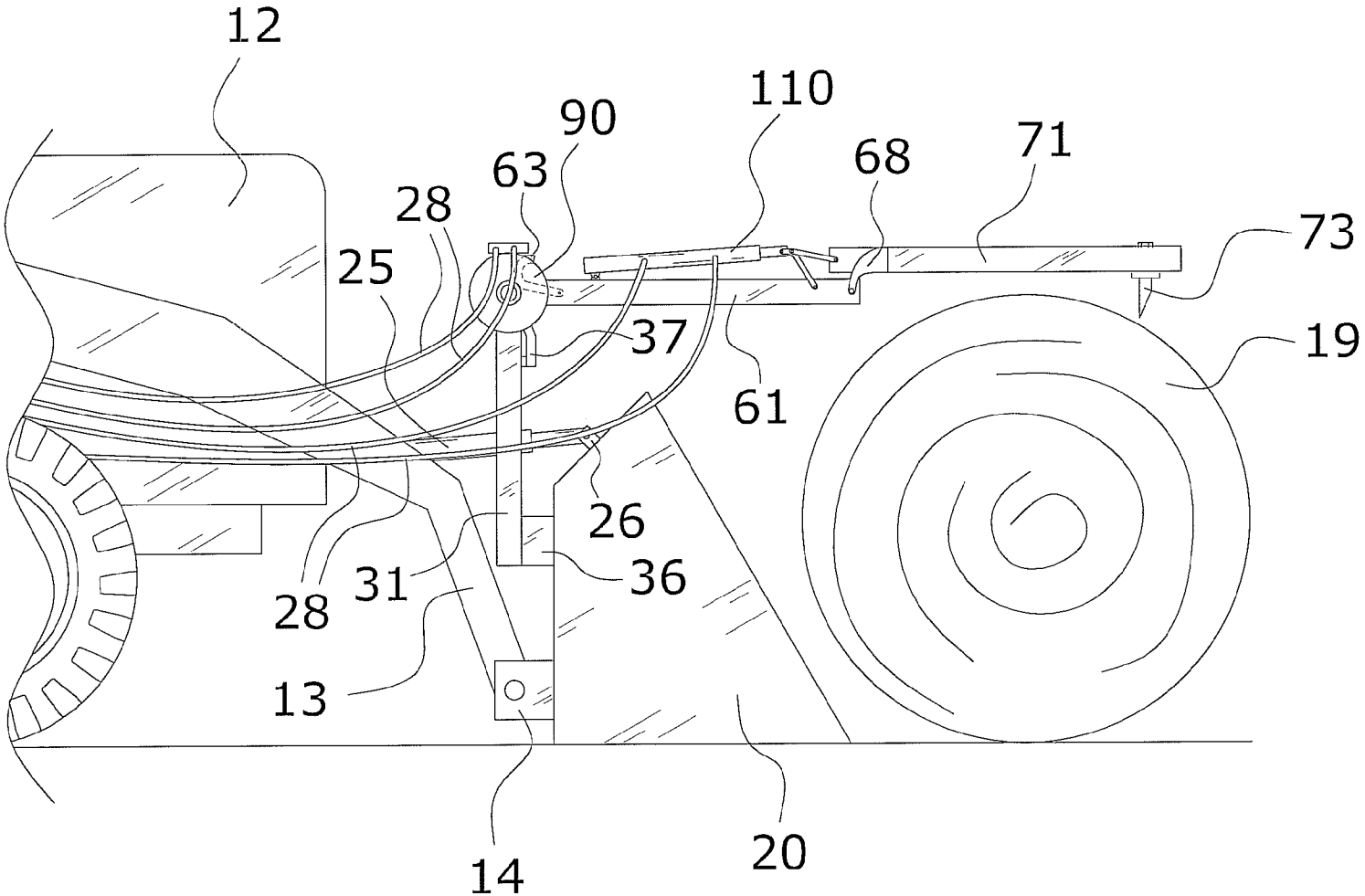
FIG. 14 is a side view of an alternate embodiment of the present invention attached to a bucket, the bucket attached to a tractor and the present invention about to grab a load.

The cross arm 72 is comprised of a structure and configuration to secure a load 19 in the bucket unit 20. The cross arm 72 may also include a plurality of hooks or projections 73. The projections 73 preferably extend perpendicular towards the ground when the grappling structure 70 is parallel with the ground, as shown in FIG. 13. The projections 73 serve to better grab a load 19 when using the grappling fork attachment 10.

H. Drive Assemblies

The new embodiment of the present invention may include various types of drive assemblies 80, 100 to pivot the extension frame 60 about the support frame 30 and the grappling structure 70 about the extension frame 60. The drive assemblies 80, 100 preferably include various types of chain and sprocket assemblies as well as different actuators 90, 110 to maneuver the various components of the grappling fork attachment 10. The drive assemblies 80, 100 are preferably controlled via hydraulic fluid and may include various electrical components as well. The drive assemblies 80, 100 further preferably include various safety valves 23, 43, 65, 75 which will be described subsequently to prevent accidental engagement of the grappling fork attachment 10.

Figure 16:
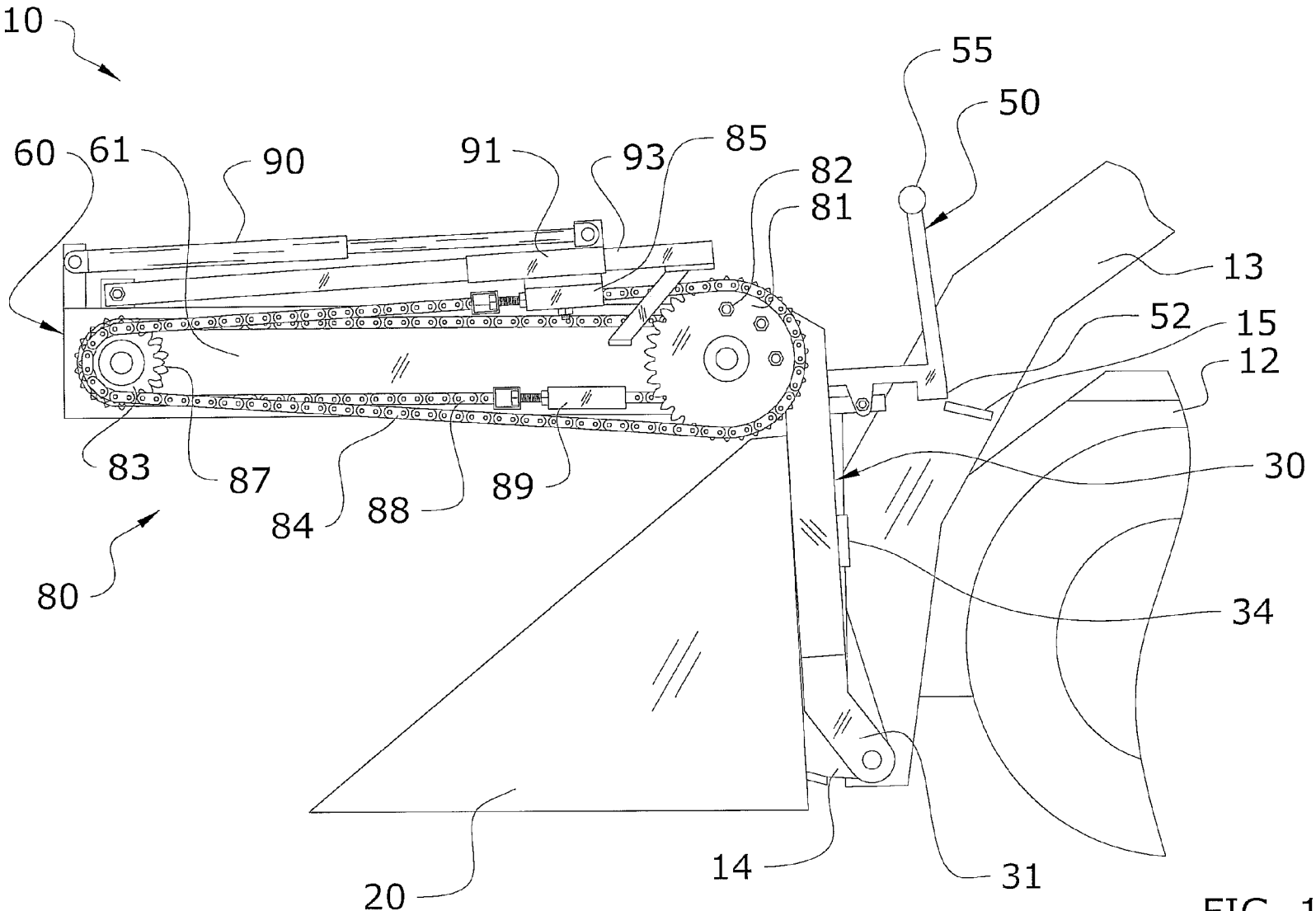
FIG. 16 is a side view of a new embodiment of the present invention with the extension frame extended perpendicularly outwards.
Figure 17:
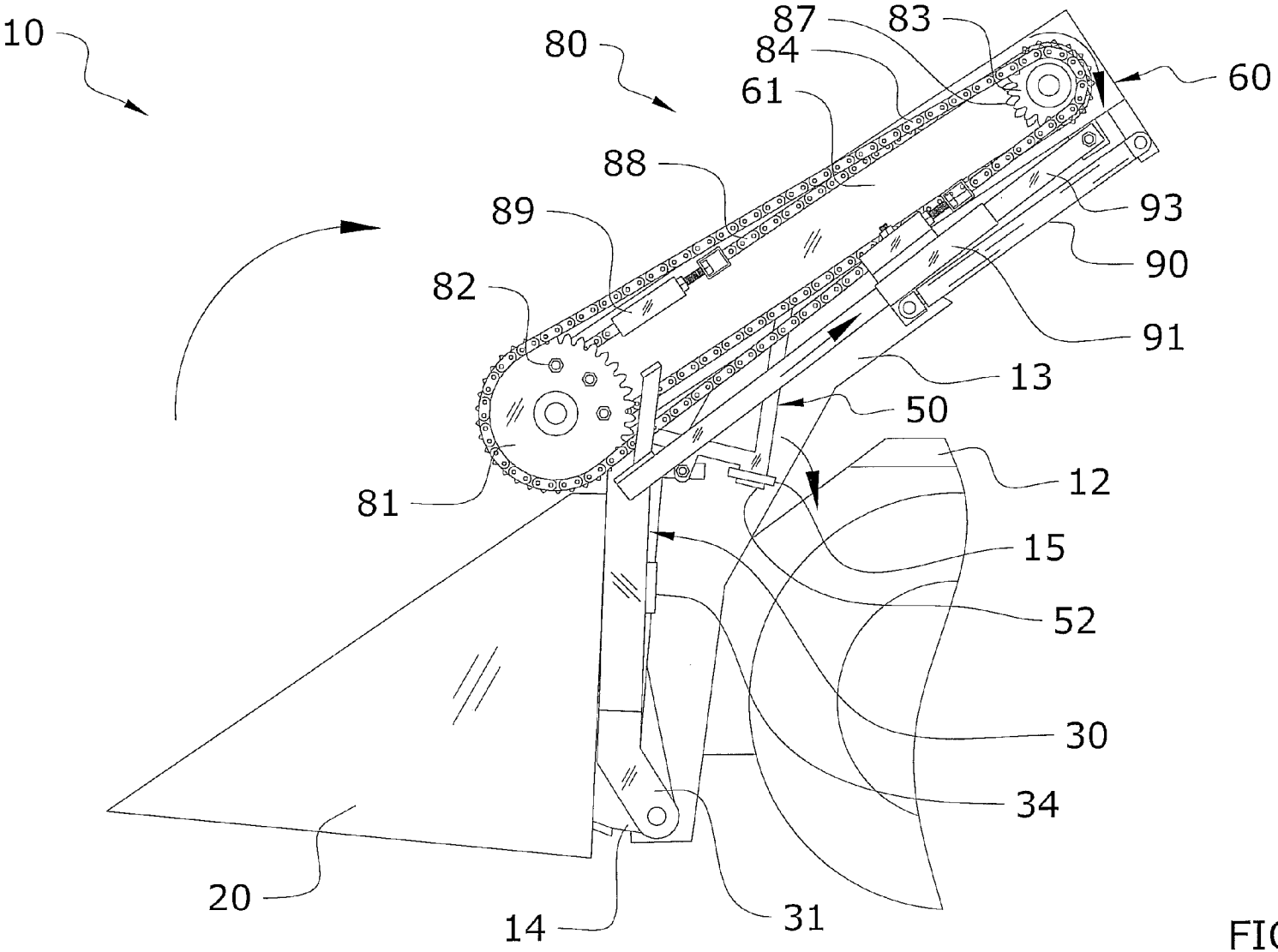
FIG. 17 is a side view of the new embodiment of the present invention with the extension frame being pivoted rearwards so as to attach the support frame to the loader arms of the tractor/skid steer loader.
Figure 18:
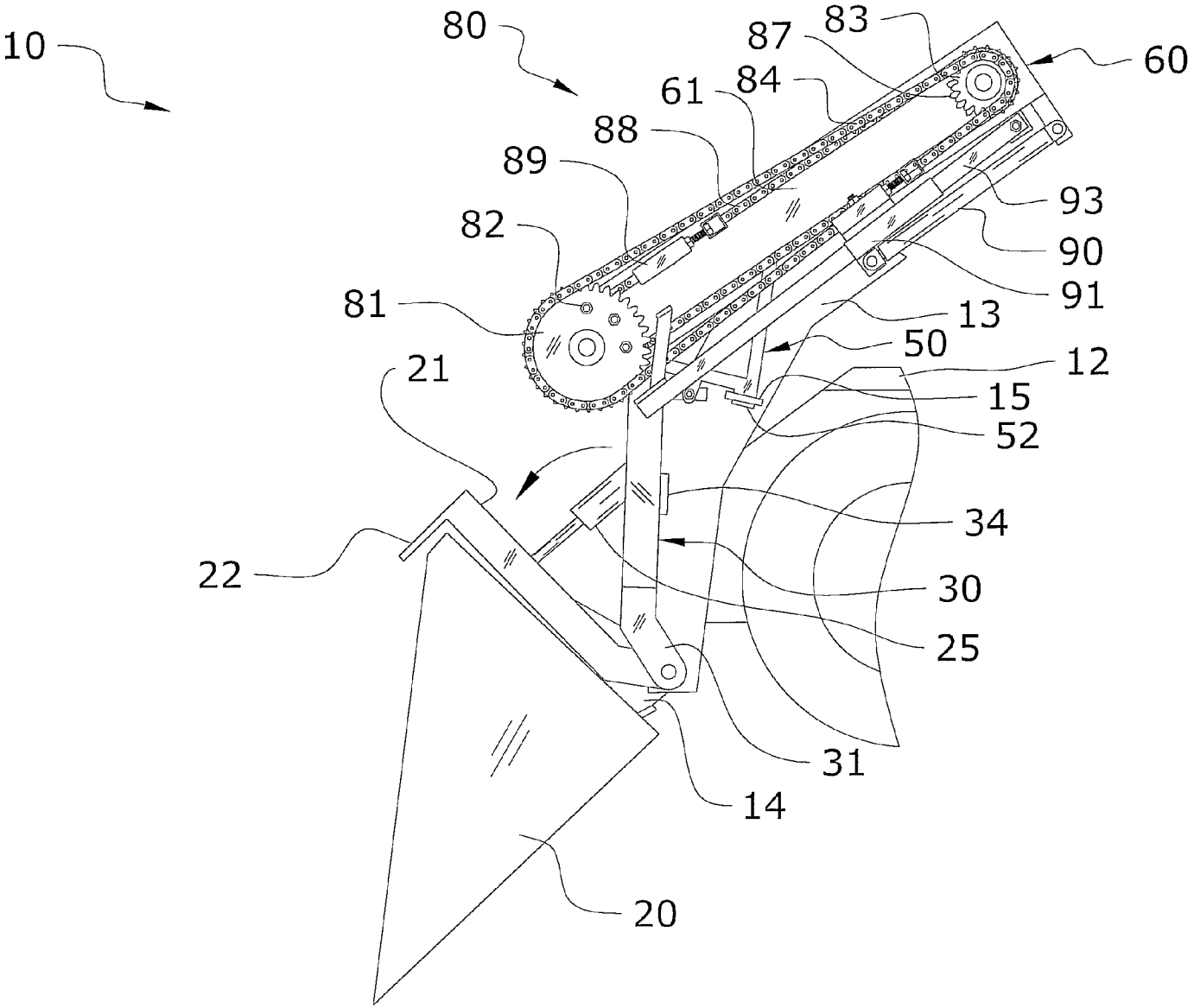
FIG. 18 is a side view of the new embodiment of the present invention with the support frame attached to the loader arms so as to allow independent movement of the bucket unit with respect to the support frame.
Figure 19:
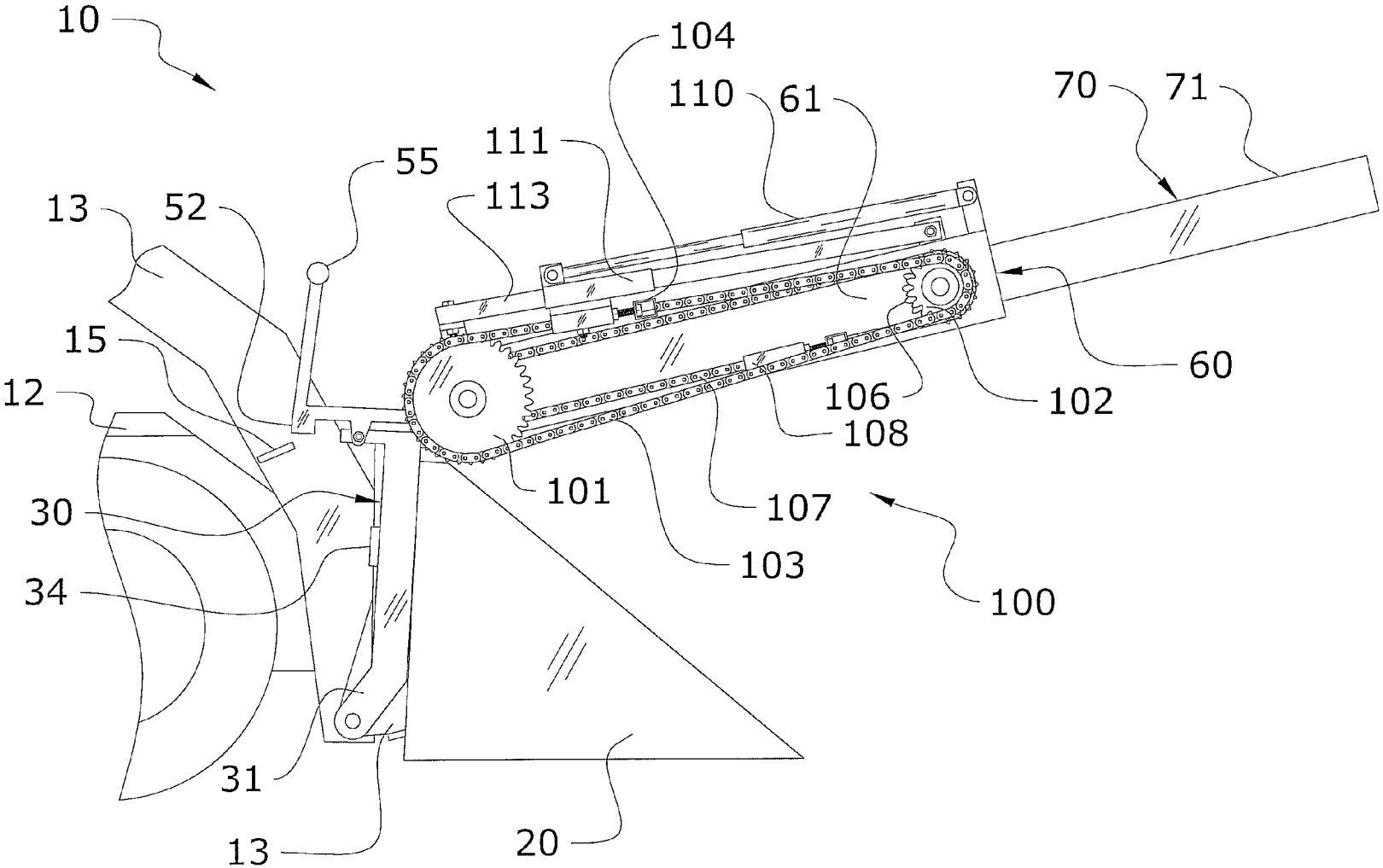
FIG. 19 is an opposite side view of the new embodiment of the present invention with the extension frame and the grappling structure extended outwards.
Figure 20:
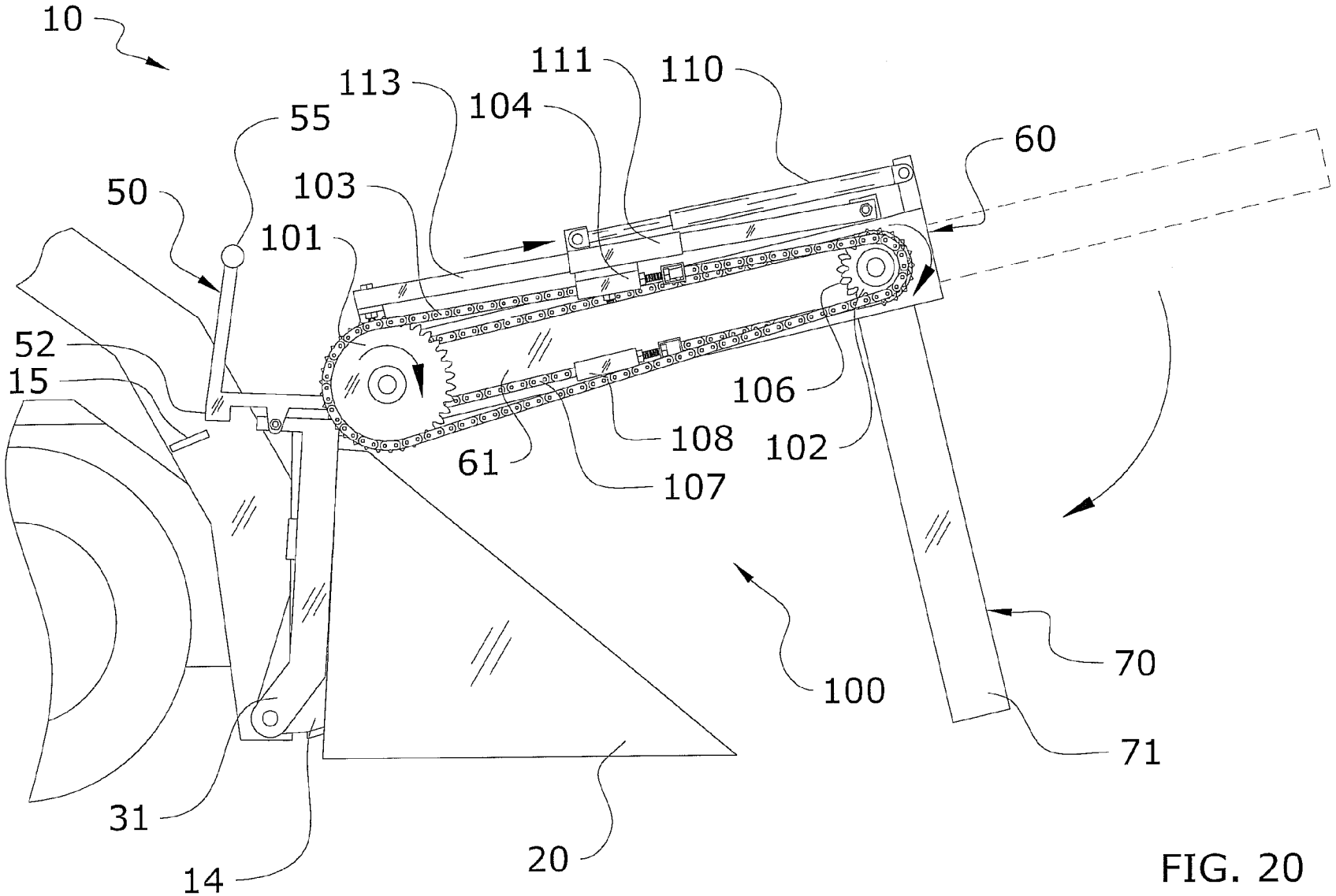
FIG. 20 is the opposite side view of the new embodiment of the present invention with the extension frame extended outwards and the grappling structure being pivoted inwards.
Figure 21:
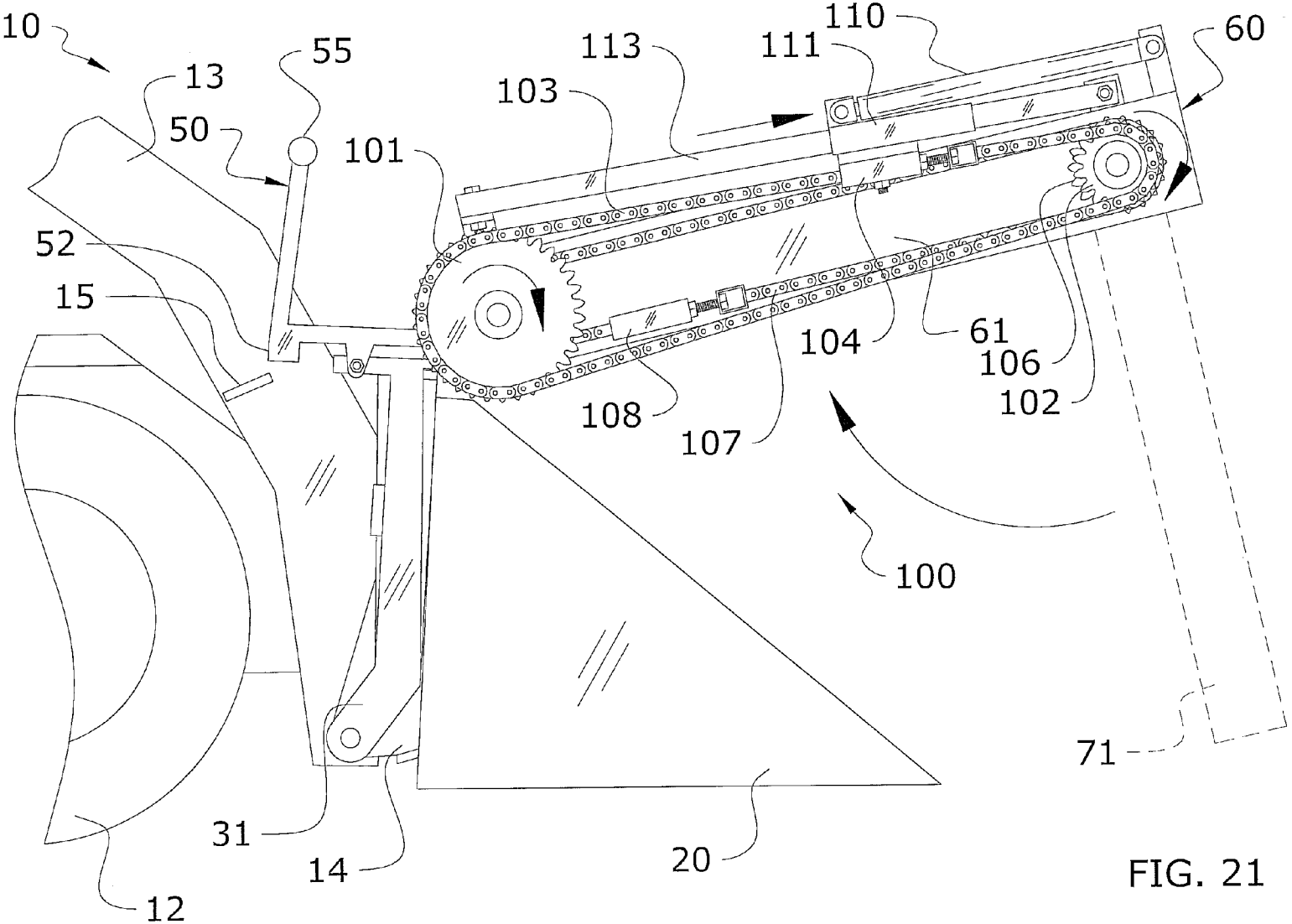
FIG. 21 is the opposite side view of the new embodiment of the present invention with the extension frame extended outwards and the grappling structure pivoted fully inwards.
Figure 22:
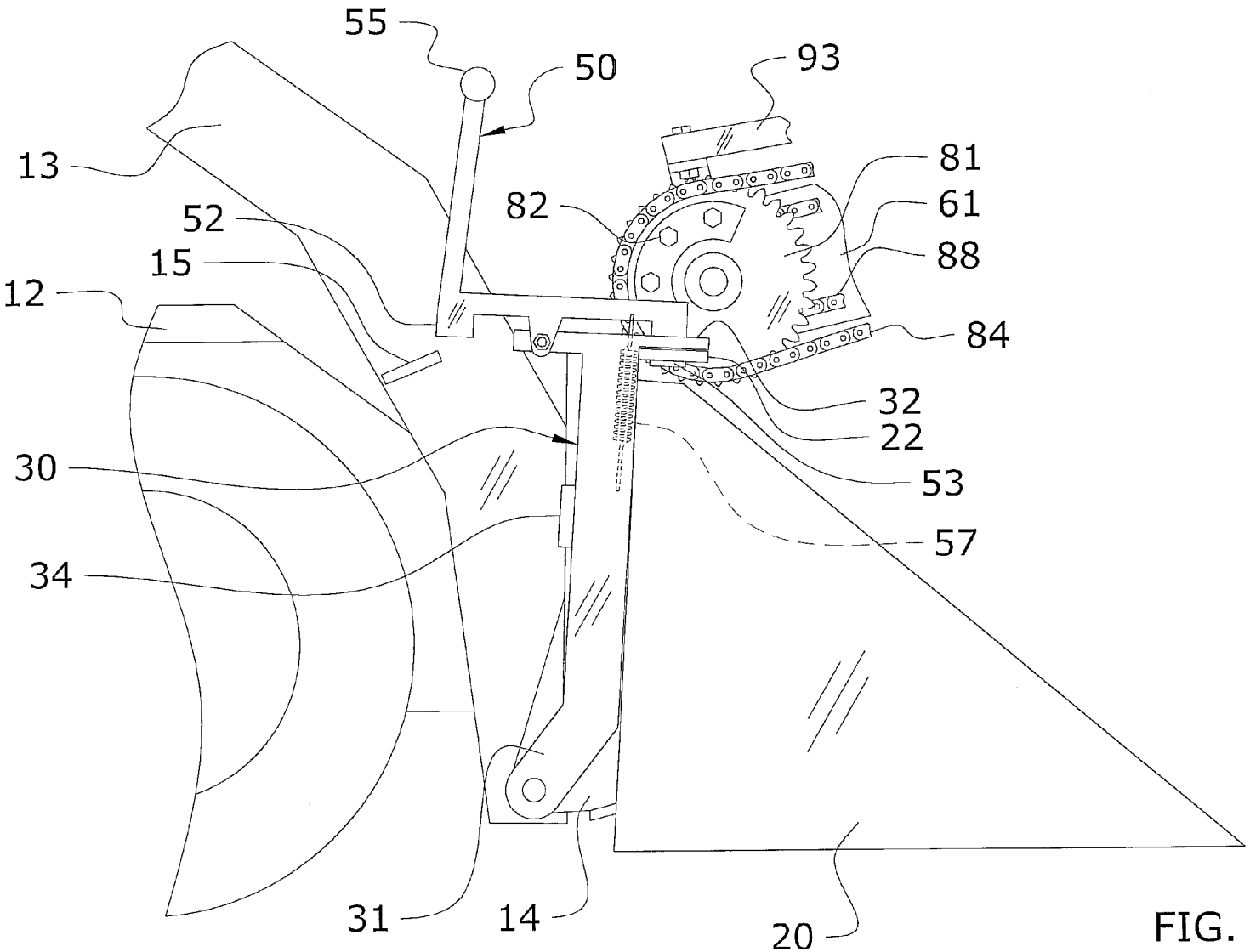
FIG. 22 is the opposite side view of the new embodiment of the present invention illustrating the alignment of the retaining flanges to receive the locking element.
Figure 23:
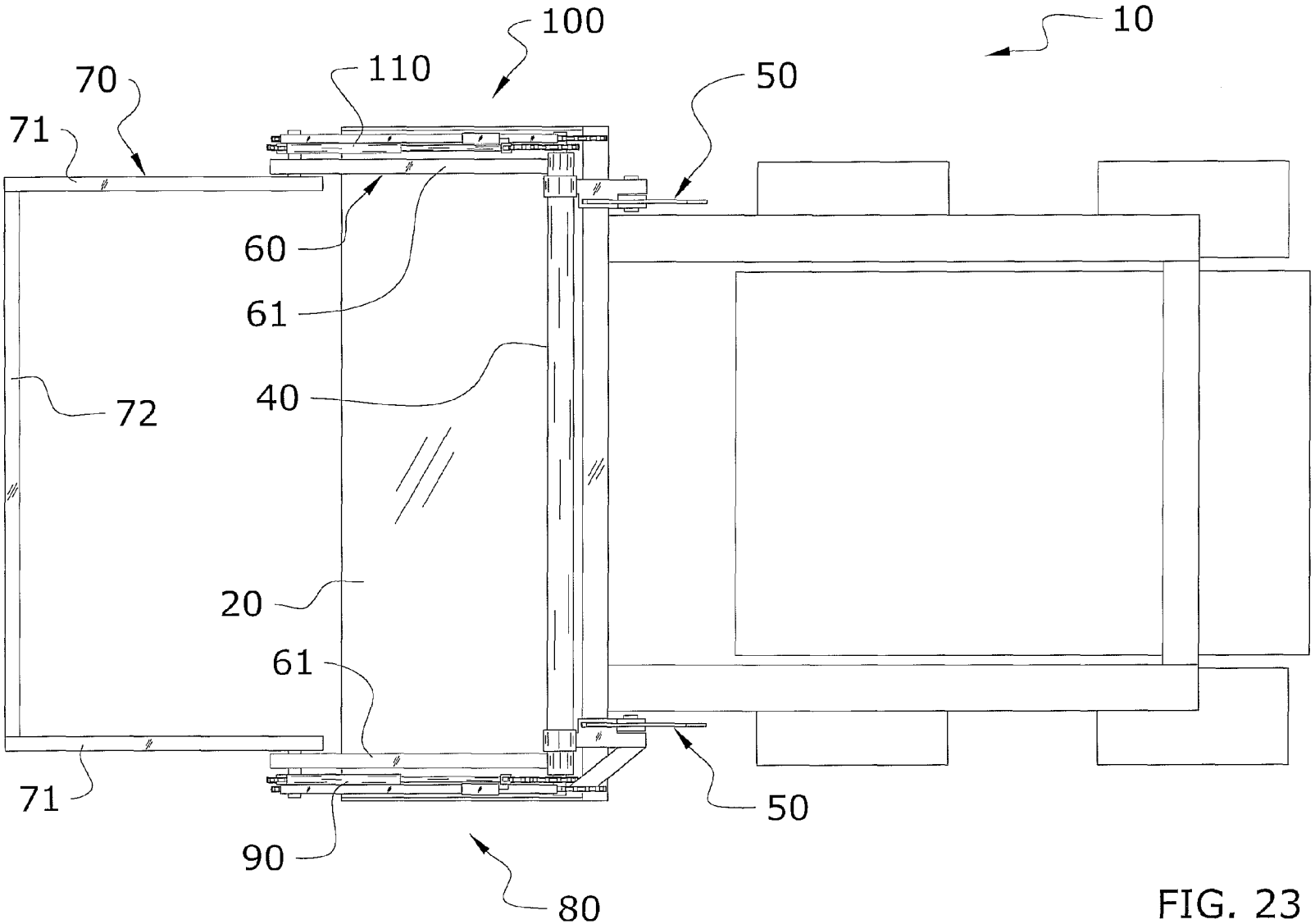
FIG. 23 is a top view of the new embodiment of the present invention.

A first drive assembly 80, as shown in FIGS. 16 through 18, is positioned upon one side of the grappling fork attachment 10 preferably parallel with and along the outside of one of the extension arms 61. The first drive assembly 80 includes an outer sprocket and chain assembly as well as an inner sprocket and chain assembly. The outer sprocket and chain assembly includes a first larger outer sprocket 81 that is preferably fixed in a non rotatable position via a plurality of fasteners 82 so as not to rotate. The first outer sprocket 81 is connected to a second outer sprocket 83 via an outer chain 84. The outer sprocket and chain assembly is used to pivot the extension frame 60 about the support frame 30.

A chain tightener/connector 85 is also interconnected in the outer chain 84 to function both as a chain tightener and to connect the outer chain to the connecting member 91 and thus actuator 90 of the first drive assembly 80. A guide element 93 is secured to the extension frame 60 and extends along the outer chain 84, wherein the connecting member 91 and chain tightener/connector 85 travel along the guide element 93 as the actuator 90 is being manipulated.

The first drive assembly 80 also includes a pair of inner sprockets 87 forming an inner sprocket and chain assembly preferably concentrically positioned with the outer sprockets 81, 83 and connected with an inner chain 88. Both of the inner sprockets 87 are rotatably movable. The inner chain is rotated around the inner sprockets via an actuator of the second drive assembly 100 which will be described subsequently. The inner sprocket 87 nearest the outer end of the extension frame 60 is connected to the respective side arm 71 of the grappling structure 70. The inner sprocket and chain assembly also include a chain tightener/connector 89.

Whereas the main purpose of the first drive assembly 80 is to pivot the extension frame 60 about the support frame 30, the main purpose of the second drive assembly 100 is to pivot the grappling structure 70 about the extension frame 60. The second drive assembly 100 includes many of the parts of the first drive assembly 80, just positioned upon the opposite side of the extension frame 60.

The second drive assembly 100, as shown in FIGS. 19 through 22, includes an outer sprocket and chain assembly as well as an inner sprocket and chain assembly. The outer sprocket and chain assembly includes a first larger outer sprocket 101 and a second outer sprocket 102 connected and rotatable via an outer chain 103. The outer sprocket and chain assembly is used to pivot the grappling structure 70 about the extension frame 60.

A chain tightener/connector 104 is also interconnected in the outer chain 103 to function both as a chain tightener and to connect the outer chain 103 to the connecting member 111 and thus actuator 110 of the second drive assembly 100. A guide element 113 is secured to the extension frame 60 and extends along the outer chain 103, wherein the connecting member 111 and chain tightener/connector 104 travel along the guide element 113 as the actuator 110 is being manipulated.

The second drive assembly 100 also includes a pair of inner sprockets 106 preferably concentrically positioned with the outer sprockets 101, 102 and connected with an inner chain 107. Both of the inner sprockets 106 are rotatably movable. The inner chain 107 is rotated around the inner sprockets 106 via the actuator 110 of the second drive assembly 100. The inner sprocket and chain assembly also include a chain tightener/connector 108. The inner sprocket 106 nearest the outer end of the extension frame 60 is connected to the respective side arm 71 of the grappling structure 70. It is appreciated that the outer chain and sprocket assembly of the second drive assembly 100 and the inner chain and sprocket assembly of both the first drive assembly 80 and the second drive assembly 100 are all interconnected and all function to pivot the grappling structure 70 about the extension frame 60.

I. Valves

The grappling fork attachment 10 uses a plurality of valves 23, 43, 65, 75 to function as safety valves so as to prevent the operator of the tractor/skid steer loader 12 from accidentally engaging the grappling fork attachment 10 in a manner that would cause harm to the operator, bystander or attached tractor/skid steer loader 12. The valves 23, 43, 65, 75 are illustrated in FIGS. 24*a* through 27*b*.

Figure 24B:
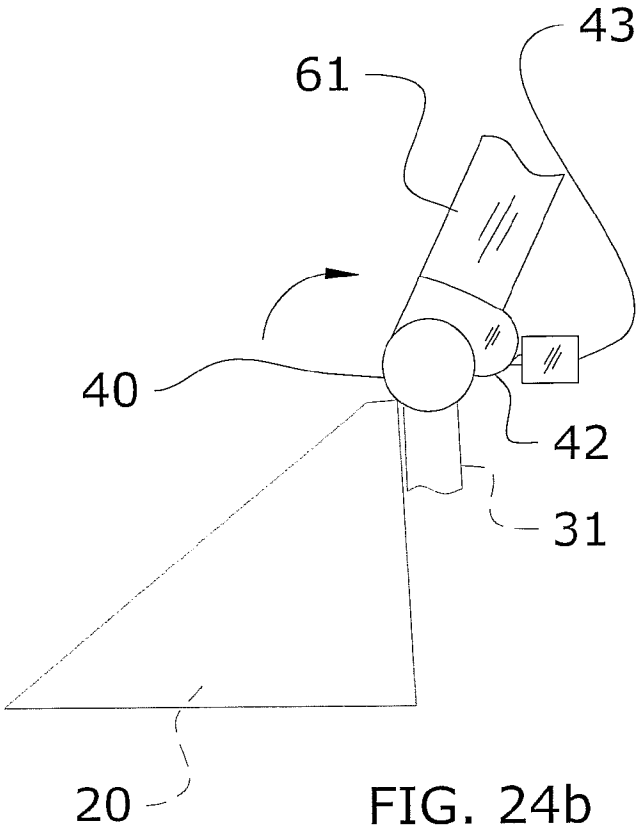
FIGS. 24*a* and 24*b* illustrate the workings of the first valve.
Figure 24A:
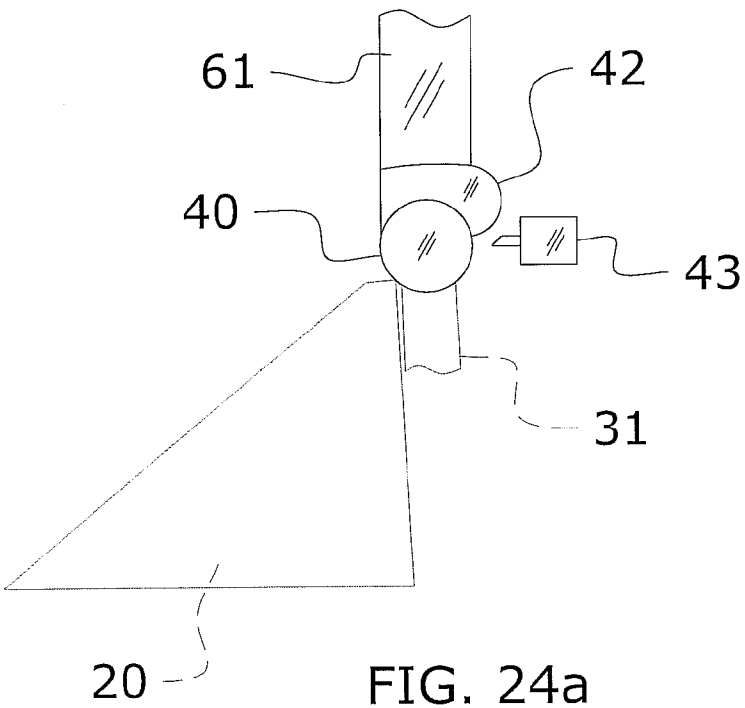

A first valve 43, as shown in FIGS. 24*a* and 24*b*, functions to prevent the extension frame 60 with the grappling structure 70 extended from moving too far rearward and engaging the tractor/skid steer loader 12. The first valve 43 is mounted proximate the cam 42 of the cross member 40 and is engaged by the cam 42 when the extension frame 60 is slightly rearward of vertical (e.g. approximately 5 degrees). The first valve is spring 57 loaded towards an open position. When the cam 42 depresses the spring 57 loaded first valve 43, the valve 43 closes and thus prevents any fluid flow to the actuator 90 of the first drive assembly 80.

Figures 25A, 25B:
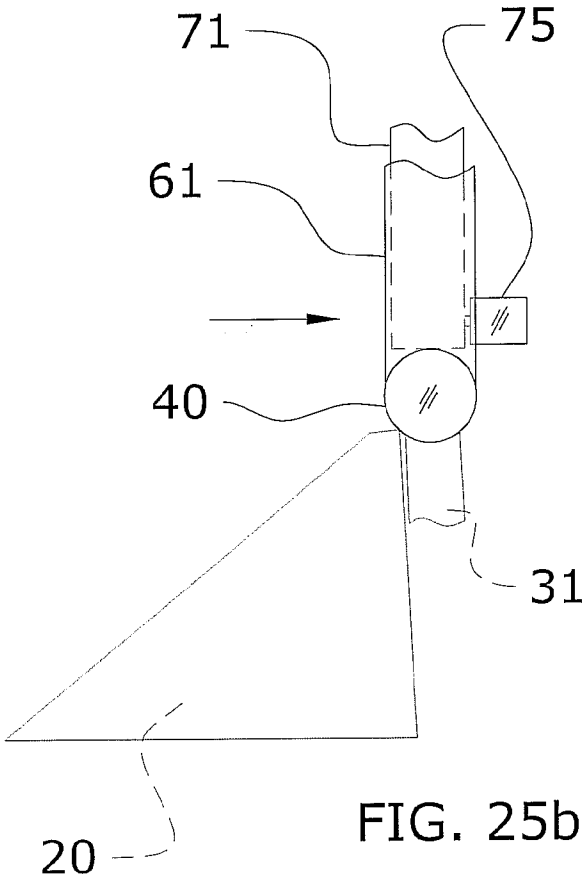
FIGS. 25*a* and 25*b* illustrate the workings of the second valve.

A bypass fluid hose 29 may be interconnected through a second valve 75 and a third valve 23 so as to control the actuator 90 of the first drive assembly 80. The second valve 75, as shown in FIGS. 25*a* and 25*b*, is spring 57 loaded to closed. The second valve 75 is mounted proximate the extension arms 61 of the extension frame 60 so as to be engaged by the side arms 71 of the grappling structure 70 when the grappling structure 70 is in a fully folded position. When engaged and depressed by the side arms 71, the second valve 75 opens.

Figure 26B:
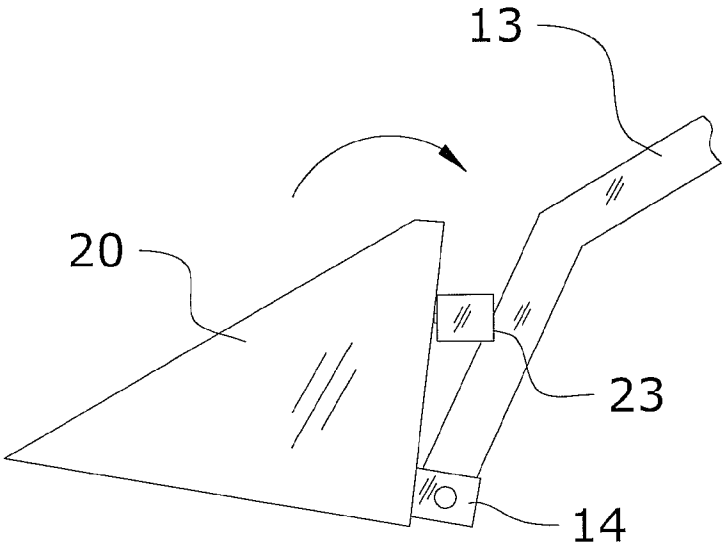
FIGS. 26*a* and 26*b* illustrate the workings of the third valve.
Figure 26A:
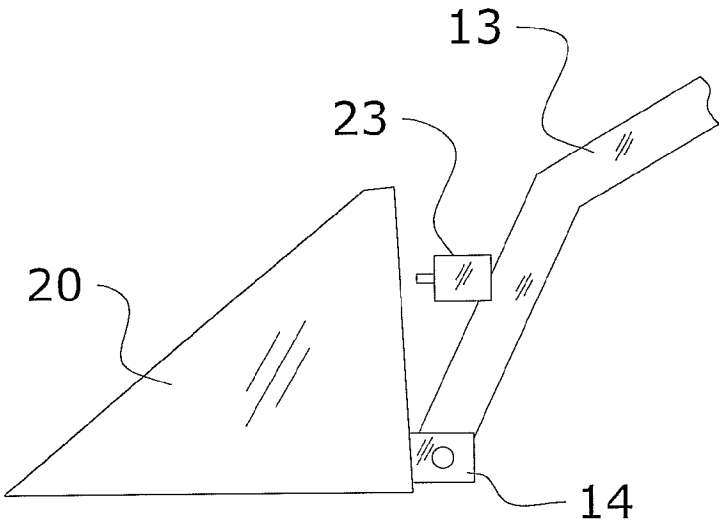

The third valve 23 makes the final opening of the bypass fluid line. The third valve 23, as shown in FIGS. 26*a* and 26*b*, is also spring 57 loaded to a closed position and is mounted upon or near the loader arms 13 so as to be engaged by the bucket unit 20 when the bucket unit 20 returns to a fully upward position. The third valve 23 prevents the flow of fluid to the actuator 90 when the bucket 20 is not depressing the third valve 23 so as to prevent accidental engagement of grappling fork attachment 10. If the bucket unit 20 is not in fully upward position, the locking element 50 will not be in a position to lock the support frame 30 to the loader arms 13. When the third valve 23 is depressed via the bucket 20 moving to a fully upward or resting position the third valve 23 is opened thus allowing fluid to flow through the bypass fluid line and the actuator 90 of the grappling fork attachment 10 to be engaged.

Figure 27B:
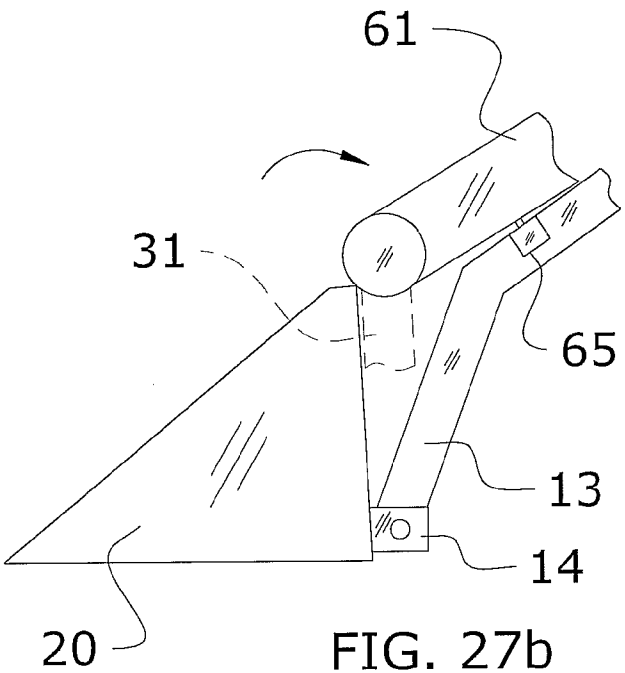
FIGS. 27*a* and 27*b* illustrate the workings of the fourth valve.
Figure 27A:
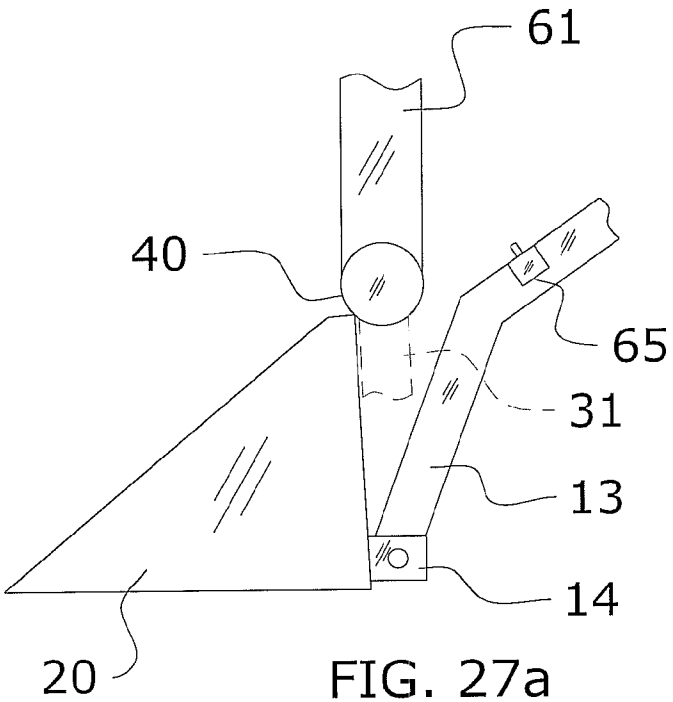

A fourth valve 65, as shown in FIGS. 27*a* and 27*b*, is spring 57 loaded to open. The fourth valve 65 is mounted proximate the loader arms 13 so as to engage the extension frame 60 or the grappling structure 70 when pivoted rearwardly near the loader arms 13 (e.g. approximately 15 degrees). The fourth valve 65 is then engaged and thus closes the fluid line to the actuator 110 of the second drive assembly 100 so that the grappling structure 70 cannot move. To use the grappling fork attachment 10 the bypass line, when both second valve 75 and third valve 23 are open, activates the actuator 90 of the first drive assembly 80 to move the extension frame 60 so as to open the first valve 43 and the fourth valve 65 and allow full functionality of the grappling fork attachment 10.

F. Operation of Invention

In use, once the grappling fork attachment 10 is attached to the bucket unit 20 via the support members 31 of the support frame 30 being pivotally attached to the support members 21 of the bucket unit 20 near the lower end, the tractor/skid steer loader 12 is started. The tractor/skid steer loader 12 provides power which creates hydraulic pressure to send to the first actuator and the second actuator. The tractor/skid steer loader 12 is driven to a location where a load 19 is desired to be moved with the grappling fork attachment 10.

When the tractor/skid steer loader 12 is aligned with the desired load 19 the grappling fork attachment 10 is engaged by engaging the actuator 90 of the first drive assembly 80 to pivot the extension frame 60 forwardly away from the loader arms 13. It is appreciated that prior to the actuator 90 being able to be engaged, the bucket unit 20 must be in a fully upward position and the locking element 50 secured to the loader arms 13.

As the extension frame 60 pivots forward, the locking element 50 is released from the loader arms 13 and the spring 57 pulls locking element 50 down and the locking element 50 subsequently is secured to the bucket unit 20 thus securing the support frame 30 to the bucket unit 20 via member 22 and 32. The actuator 90 retracts and causes the connecting member 91 to move along the guide element 93 and outer chain 84. This also causes the second outer sprocket 83 of the first drive assembly 80 to rotatably climb along the chain 84 and ultimately pivot the extension frame 60 about the support frame 30. It is essential that the first outer sprocket 81 remain immovable permanently to allow the extension frame 60 to pivot about the support frame 30. The chain 84 climbs around sprocket 81 causing the extension frame 60 to move rotationally.

The actuator 110 of the second drive assembly 100 now may be engaged. As the actuator 110 is extending or retracting, the connecting member 111 connected to the chain tightener/connector 104 moves along the guide element 113 and also moves the outer chain 103 thus rotating the outer chain 103 along the outer sprockets 101, 102. The outer sprockets 101, 102 are tied to the inner sprocket and chain assembly of both the first drive assembly 80 and the second drive assembly 100 which rotates along with the outer sprocket and chain assembly of the second drive assembly 100 to pivot the grappling structure 70. It is appreciated that the side arms 71 of the grappling structure 70 are connected to the end inner sprockets 87, 106 so as to rotate along with the inner sprockets 87, 106. The inner sprocket and chain assembly of the first drive assembly 80 are connected to the second drive assembly 100 via the cross member 40 or an internal shaft extending within the cross member 40.

Figure 15:
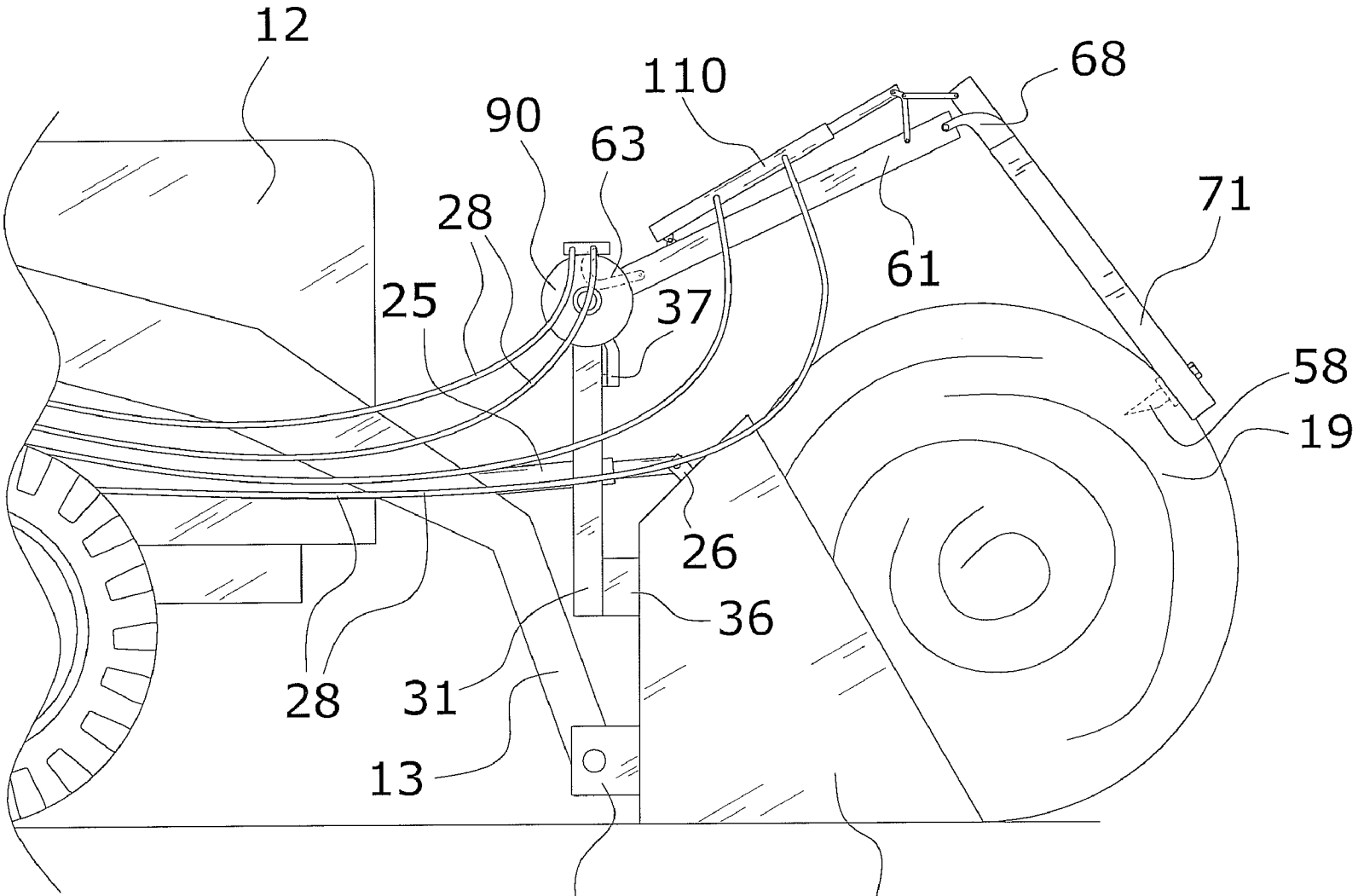
FIG. 15 is a side view of an alternate embodiment of the present invention attached to a bucket, the bucket attached to a tractor and the present invention grabbing a load and securing the load in the bucket.

The actuators 90, 110 may be controlled from the operator cab of the tractor/skid steer loader 12 through various levers or adjustment knobs. Once the grappling structure 70 is over or beyond the load 19, the grappling structure 70 is pivotally rotated towards the ground, pushing the load 19 into the bucket unit 20, as shown in FIGS. 13 and 15. It is appreciated that during use of the grappling fork attachment 10, the operator maintains full control of the bucket unit 20.

The grappling structure 70 of the grappling fork attachment 10 may now be elevated again for use with additional loads 19. The grappling fork attachment 10 may also be pivotally rotated towards a non-use position, by reversing the previous described steps. In the non-use position the grappling fork attachment 10 is positioned behind the bucket unit 20.

What has been described and illustrated herein is a preferred embodiment of the invention along with some of its variations. The terms, descriptions and figures used herein are set forth by way of illustration only and are not meant as limitations. Those skilled in the art will recognize that many variations are possible within the spirit and scope of the invention, which is intended to be defined by the following claims (and their equivalents) in which all terms are meant in their broadest reasonable sense unless otherwise indicated. Any headings utilized within the description are for convenience only and have no legal or limiting effect.

I claim:

1. A grappling fork attachment system, comprising:

a tractor including a bucket unit and a pair of loader arms, wherein said pair of loader arms move said bucket unit;

a support frame attached to said tractor;

an extension frame pivotally attached to said support frame;

a first drive assembly mounted proximate said extension frame for pivoting said extension frame about said support frame;

a grappling structure pivotally attached to said extension frame for grabbing and securing a load within said bucket unit;

a second drive assembly mounted proximate said extension frame for pivoting said grappling structure about said extension frame;

wherein said support frame is pivotally attached to said tractor between said pair of loader arms and said bucket unit; and at least one locking element pivotally connected to said support frame to alternately secure said support frame to one of said bucket unit and said pair of loader arms.

2. The grappling fork attachment system of claim 1, wherein said bucket unit moves independent of said support frame when said locking element is secured to said pair of loader arms.

3. The grappling fork attachment system of claim 1, wherein said locking element includes a catch element, wherein a pivotal movement of said extension frame causes said extension frame to engage said catch portion of said locking element.

4. The grappling fork attachment system of claim 1, wherein said locking element is comprised of a rocker arm.

5. The grappling fork attachment system of claim 4, wherein said locking element includes a spring to move said locking element.

6. The grappling fork attachment system of claim 1, wherein said grappling structure is positioned completely behind said bucket unit in a resting position and positioned at least partially above said bucket unit in an in use position.

7. The grappling fork attachment system of claim 1, wherein said first drive assembly includes at least one chain and sprocket assembly.

8. The grappling fork attachment system of claim 1, wherein said second drive assembly includes at least one chain and sprocket assembly.

9. The grappling fork attachment system of claim 1, including a plurality of projections extending from said grappling structure.

10. A grappling fork attachment system, comprising:

a tractor including a bucket unit and a pair of loader arms, wherein said pair of loader arms move said bucket unit;

a support frame attached to said tractor;

wherein said support frame is pivotally attached to said tractor between said pair of loader arms and said bucket unit;

at least one locking element pivotally connected to said support frame to alternately secure said support frame to one of said bucket unit and said pair of loader arms;

wherein said bucket unit moves independent of said support frame when said locking element is secured to said pair of loader arms;

an extension frame pivotally attached to said support frame;

wherein said locking element includes a catch element, wherein a pivotal movement of said extension frame causes said extension frame to engage said catch portion of said locking element;

a first drive assembly mounted proximate said extension frame for pivoting said extension frame about said support frame;

wherein said first drive assembly includes an outer chain and sprocket assembly and an inner chain and sprocket assembly;

wherein an outer sprocket of said outer chain and sprocket assembly is immovable;

wherein said first drive assembly includes at least one actuator;

a grappling structure pivotally attached to said extension frame for grabbing and securing a load within said bucket unit;

wherein said support frame and said grappling structure are pivotally mounted on opposite ends of said extension frame;

wherein said grappling structure is positioned completely behind said bucket unit in a resting position and positioned at least partially above said bucket unit in an in use position; and a second drive assembly mounted proximate said extension frame for pivoting said grappling structure about said extension frame;

wherein said second drive assembly includes an outer chain and sprocket assembly and an inner chain and sprocket assembly;

wherein said second drive assembly includes at least one actuator.

* * * * *